US009859605B2

(12) United States Patent
Mukai et al.

(10) Patent No.: US 9,859,605 B2
(45) Date of Patent: Jan. 2, 2018

(54) ANTENNA DEVICE, CONVERSION ADAPTOR, AND RECEIVER

(75) Inventors: Koichi Mukai, Ishikawa (JP); Yoshitaka Yoshino, Tokyo (JP); Chisato Komori, Ishikawa (JP); Yuuji Miyazaki, Ishikawa (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 624 days.

(21) Appl. No.: 12/729,431

(22) Filed: Mar. 23, 2010

(65) Prior Publication Data

US 2010/0245185 A1 Sep. 30, 2010

(30) Foreign Application Priority Data

Mar. 30, 2009 (JP) ..... 2009-083213

(51) Int. Cl.

| | |
|---|---|
| ***H01Q 1/08*** | (2006.01) |
| ***H01Q 1/10*** | (2006.01) |
| ***H01Q 1/12*** | (2006.01) |
| ***H01Q 1/44*** | (2006.01) |
| ***H01Q 1/27*** | (2006.01) |
| ***H01R 24/58*** | (2011.01) |
| ***H01R 31/06*** | (2006.01) |
| *H01R 103/00* | (2006.01) |

(52) U.S. Cl.

CPC ..... *H01Q 1/084* (2013.01); *H01Q 1/10* (2013.01); *H01Q 1/1207* (2013.01); *H01Q 1/273* (2013.01); *H01Q 1/44* (2013.01); *H01R 24/58* (2013.01); *H01R 31/06* (2013.01); *H01R 2103/00* (2013.01); *H01R 2201/02* (2013.01)

(58) Field of Classification Search

CPC ..... H01Q 1/12; H01Q 1/1207; H01Q 1/24; H01Q 1/273; H01Q 1/44; H01Q 1/10; H01Q 1/084; H01R 31/06; H01R 2103/00; H01R 2201/02

USPC ..... 343/702, 882, 906

See application file for complete search history.

(56) References Cited

U.S. PATENT DOCUMENTS 4,074,271 A * 2/1978 Sakuma ..... H01Q 1/084 343/715
5,218,370 A * 6/1993 Blaese ..... H01Q 1/084 343/702

(Continued)

FOREIGN PATENT DOCUMENTS

DE 195 00 928 A1 7/1995
EP 1 624 586 A1 2/2006

(Continued)

OTHER PUBLICATIONS

U.S. Appl. No. 15/277,699, filed Sep. 27, 2016, Yoshino et al.
U.S. Appl. No. 14/898,940, filed Dec. 16, 2015, Murakami et al.

*Primary Examiner* — Dameon E Levi
*Assistant Examiner* — Jennifer F Hu
(74) *Attorney, Agent, or Firm* — Wolf, Greenfield & Sacks, P.C.

(57) ABSTRACT

An antenna device includes a round plug having a rotation mechanism section on one end thereof, where round plug is removably attached to a round jack arranged in an electronic apparatus; and a rod antenna element. In the antenna device, the rod antenna element is connected to the rotation mechanism section of the round plug and rotatable in a predetermined direction.

18 Claims, 31 Drawing Sheets

(56) References Cited

U.S. PATENT DOCUMENTS

| | | | | |
|---|---|---|---|---|
| 5,949,379 | A * | 9/1999 | Yang | H01Q 1/24 343/702 |
| 6,411,265 | B1 * | 6/2002 | Tsai | H01Q 1/22 343/702 |
| 6,615,055 | B1 * | 9/2003 | Aoto | H01Q 1/084 343/702 |
| 6,853,353 | B2 * | 2/2005 | Wang | G06F 1/1632 343/882 |
| 7,064,720 | B2 * | 6/2006 | Yoshino | H01Q 1/24 343/702 |
| 8,243,958 | B2 * | 8/2012 | Kimura et al. | 381/111 |
| 8,487,827 | B2 | 7/2013 | Mukai et al. | |
| 8,780,011 | B2 | 7/2014 | Yoshino et al. | |
| 2007/0105438 | A1 | 5/2007 | Yoshino | |
| 2008/0122711 | A1 | 5/2008 | Kimura et al. | |
| 2008/0207061 | A1 | 8/2008 | Mukai et al. | |
| 2010/0039348 | A1 * | 2/2010 | Tsai | H01Q 1/1207 343/878 |
| 2010/0238088 | A1 | 9/2010 | Mukai et al. | |
| 2012/0050133 | A1 | 3/2012 | Yoshino et al. | |
| 2013/0009835 | A1 | 1/2013 | Yoshino et al. | |
| 2014/0333493 | A1 | 11/2014 | Yoshino et al. | |
| 2015/0055020 | A1 | 2/2015 | Yoshino et al. | |
| 2015/0200464 | A1 | 7/2015 | Yoshino et al. | |
| 2016/0372814 | A1 * | 12/2016 | Murakami | H01Q 9/30 |
| 2017/0018854 | A1 * | 1/2017 | Yoshino | H01Q 1/46 |

FOREIGN PATENT DOCUMENTS

| | | | |
|---|---|---|---|
| JP | 58-219801 | A | 12/1983 |
| JP | 11-355019 | | 12/1999 |
| JP | 11-355019 | A | 12/1999 |
| JP | 2002-026622 | | 1/2002 |
| JP | 2002-026622 | A | 1/2002 |
| JP | 2007-067774 | | 3/2007 |
| JP | 2007-067774 | A | 3/2007 |
| JP | 2007-281831 | A | 10/2007 |
| JP | 2007-281832 | | 10/2007 |
| WO | WO 97/33338 | A1 | 9/1997 |
| WO | WO 2009/011515 | A1 | 1/2009 |

* cited by examiner

FIG. 1A
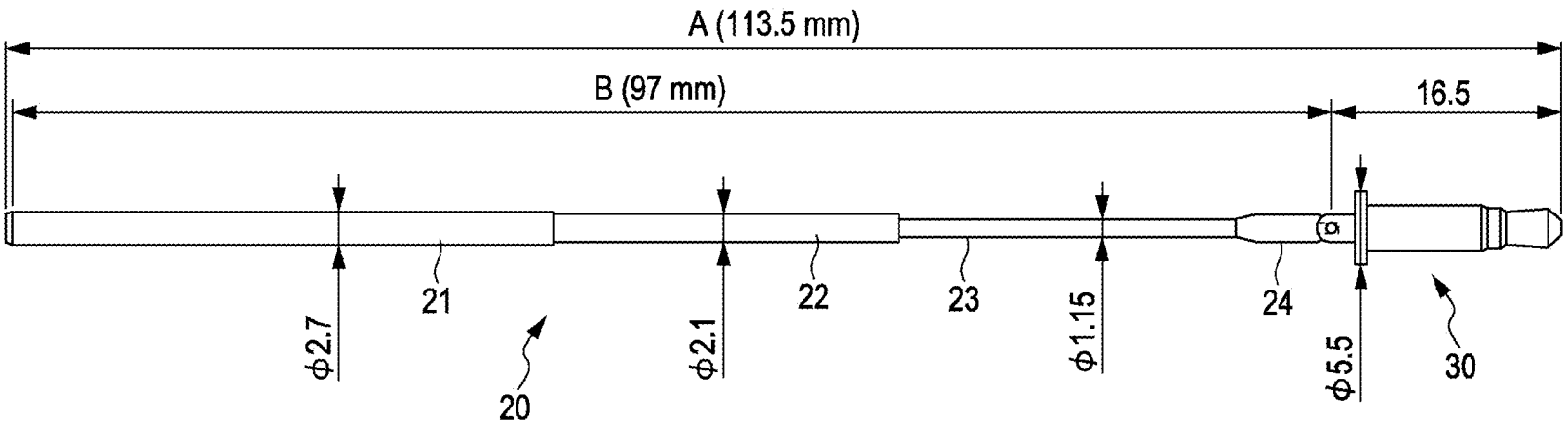
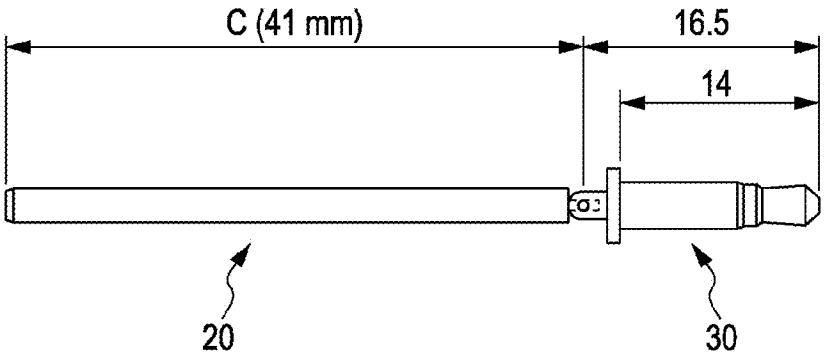
FIG. 1B 24
242
242
242
242
242
241a

NOTCH FOR LOCK
241
241a
402
402a
404
403a
40
403
303

20
24
NOTCH FOR LOCK
306
307
303
305
304

20
24
404
305
304

306
307
308

313
3131
3132
3122
3121
312
311
40A
413
413a
412
412a 24
242
242
242
242
242
241a

NOTCH FOR LOCK
241
241a
412
414
412a
413a
413

20
24
NOTCH FOR LOCK
311
313
312

20
24
414

323
324
311
313
312

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −9.73 | −10.91 | −16.66 | −14.61 | −11.36 | −14.62 | −16.25 | −15.58 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −2.20 | −1.49 | −1.84 | −2.48 | −3.72 | 0.25 | −0.05 | −4.33 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −5.73 | −6.20 | −5.93 | −6.74 | −4.76 | −1.35 | −2.85 | −11.68 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.20 | −8.89 | −6.73 | −7.81 | −5.56 | −3.35 | −4.65 | −10.58 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.93 | −2.60 | −1.24 | −5.28 | −1.96 | 0.05 | −2.85 | −5.38 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.60 | −4.49 | −3.04 | −4.41 | −1.96 | −4.13 | −3.65 | −6.93 |

| | VERTICAL POLARIZATION | | | | | | |
|---|---|---|---|---|---|---|---|
| FREQUENCY [MHz] | 470 | 520 | 570 | 620 | 670 | 720 | 770 | 906 |
| PEAK GAIN [dBd] | −11.60 | −13.09 | −17.04 | −16.94 | −12.72 | −11.60 | −15.45 | −19.49 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −4.53 | −2.89 | −2.84 | −5.21 | −5.12 | −0.95 | 0.35 | −10.48 |

| | VERTICAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −12.73 | −14.00 | −16.04 | −16.48 | −14.36 | −11.33 | −13.05 | −13.58 |

| | HORIZONTAL POLARIZATION | | | | | | | |
|---|---|---|---|---|---|---|---|---|
| FREQUENCY [MHz] | 470 | 520 | 570 | 620 | 670 | 720 | 770 | 906 |
| PEAK GAIN [dBd] | −1.80 | −1.29 | −1.04 | −3.48 | −3.47 | −1.15 | 0.55 | −6.93 |

ANTENNA DEVICE, CONVERSION ADAPTOR, AND RECEIVER

BACKGROUND OF THE INVENTION

1. Field of the Invention

The present invention relates to an antenna device, a conversion adaptor, and a receiver, which are applicable to portable electronics, such as potable AV equipment and cell phones.

2. Description of the Related Art

Rod-like antennas have been widely known as antenna devices. A helical antenna is also shaped like a rod and known as one of the rod-like antennas. The helical antenna includes a short, coiled spring-shape antenna element housed in a flexible tube. For small portable television sets, radio sets, and the like, telescopic rod antennas are used.

In addition, various kinds of rod antennas provided with rotation mechanisms, such as hinges, have been proposed (see, for example, Japanese Unexamined Patent Application Publication Nos. 2007-67774, 2002-26622, and 11-355019. The rod antennas disclosed in these patent documents typically desire complicated structures for the rotation mechanism. For addressing such a matter, Japanese Unexamined Patent Application Publication No. 2007-281832 proposes that the use of a round-shape plug.

SUMMARY OF THE INVENTION

However, the antenna device disclosed in Japanese Unexamined Patent Application Publication No. 2007-281832 is typically provides with a complicated structure for connection between a plug and an antenna member. In addition, the antenna device disclosed in this patent document is also provided with an electrical connection mechanism, such as one processed by soldering the parts to a connector member. Thus, additional parts are typically used for the process. Furthermore, such a kind of the antenna device is typically provided with many parts for connecting the rod antenna member to the plug.

Thus, in the antenna device disclosed in the above patent document, any complicated structure is desired for detachably connecting the rod antenna member to the connector member. Soldering work is also desired for the electrical connection in the antenna device. In addition, for ensuring the mechanical strength as well as the electric connection, sheet metals are typically swaged or crimped and components may be also screw fixed. In order to protect the connected portion, molding work and casing work are also desired. Thus, the antenna device is typically produced in undesired large size at a high cost because of using increased numbers of parts and working processes.

Furthermore, such a complicated process of manufacturing the antenna device may be hardly subjected to thermal processing if the rotation mechanical section includes a locking mechanism made of resin such as POM.

Any of the antenna devices disclosed in the aforementioned patent documents, Japanese Unexamined Patent Application Publication Nos. 2007-67774, 2002-26622, and 11-355019, employs a thread connection as a way of attaching the rod antenna to the electronic apparatus, such as a cell phone. Thus, the rod antenna is a threaded one. In such an electronic apparatus, in general, the rod antenna mechanism is installed in the inside thereof so that the rod antenna can be extended in use. However, the main body of the apparatus is typically provided with a redundant space for installing the rod antenna in the apparatus. Thus, the configuration of the apparatus is complicated. Specifically, so-called one-segment broadcasting which has been started recently and some of mobile communication apparatuses, such as cell phones and mobile terminal devices, are configured to watch TV programs. In any of these apparatuses, the use of rod antenna leads to an increase in size and complicates the configuration thereof.

To avoid an increase in size and complication, the technology of built-in antenna has been developed and the number of the apparatuses with built-in antenna increased. However, the characteristics of the antenna may be extensively decreased depending on the use situation. In the case of a foldable cell phone, for instance, it can show good characteristics of the antenna in the unfolded state but extensively poor in the folded state. For example, it may decrease 10 dB or more. If the apparatus is used in hand, the built-in antenna can be hidden by the hand and the receiver sensitivity thereof can be decreased.

It is desirable to provide an antenna device, a conversion adapter, and a receiver, which can reduce the number of components and the number of manufacturing steps, minimize the size and cost of the device, allow the device to be removably attached to an electronic apparatus without difficulty, and prevents the receiver sensitivity from deteriorating.

An antenna device according to a first embodiment of the present invention includes: a round plug having a rotation mechanism section on one end thereof, where the round plug is removably attached to a round jack arranged in an electronic apparatus; and a rod antenna element. In this antenna device, the rod antenna element is connected to the rotation mechanism section of the round plug and rotatable in a predetermined direction.

A conversion adaptor according to a second embodiment of the present invention includes: a round jack to which a round plug of an antenna device is removably attached; a plug having a plurality of pins connected to the respective pins of the round jack, which can be connected to an electronic apparatus (connection target). In this conversion adaptor, a capacitor is connected between the pins of the round jack.

A receiver according to a third embodiment of the present invention includes: an antenna device having a round plug; a conversion adapter including a round jack to which the round plug of the antenna device is removably attached and a conversion plug having a plurality of pins to be connected to the respective pins of the round jack; and an electronic apparatus having a function of receiving a broadcast wave and having a jack to which the conversion plug of the conversion adapter is removably attached. In this receiver, the antenna device includes a rotation mechanism section arranged on one end of the plug and a rod antenna element. In this receiver, furthermore, the rod antenna element is connected to the rotation mechanism section of the round plug and rotatable in a predetermined direction.

A receiver according to a fourth embodiment of the present invention includes: an antenna device having a round plug; a conversion adapter including a round jack to which the round plug of the antenna device is removably attached and a conversion plug having a plurality of pins to be connected to the respective pins of the round jack; and an electronic apparatus having a function of receiving a broadcast wave and having a jack to which the conversion plug of the conversion adapter is removably attached. IN this receiver, a capacitor is connected to at least one of between transmission lines of the antenna device, between pins of the round jack of the conversion adapter, and between pins of the jack of the electronic apparatus (connection target).

According to any embodiment of the present invention, there is provided any of an antenna device, a conversion adapter, and a receiver, which can reduce the number of components and the number of manufacturing steps, minimize the size and cost of the device, allow the device to be removably attached to an electronic apparatus without difficulty, and prevents the receiver sensitivity from deteriorating.

BRIEF DESCRIPTION OF THE DRAWINGS

FIG. 1A and FIG. 1B are diagrams illustrating an exemplary configuration of an antenna device as a first embodiment of the present invention;

DESCRIPTION OF THE PREFERRED EMBODIMENTS

Hereinafter, embodiments of the present invention will be described with reference to the attached drawings. The embodiments will be described in the following order:

1. First Embodiment (First exemplary configuration of antenna device);
2. Second Embodiment (Second exemplary configuration of antenna device);

3. Third Embodiment (Third exemplary configuration of antenna device);
4. Fourth embodiment (First exemplary configuration of receiving system (receiver));
5. Fifth embodiment (Second exemplary configuration of receiving system (receiver));
6. Sixth embodiment (Third exemplary configuration of receiving system (receiver)); and
7. Seventh embodiment (Exemplary configuration of plug conversion adapter).

1. First Embodiment

Figure 2A:
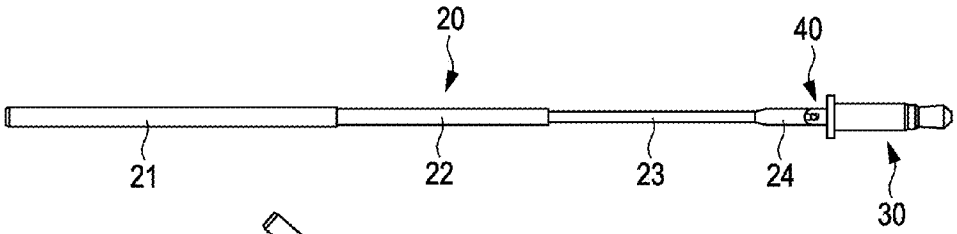
FIGS. 2A to 2C are diagrams illustrating an exemplary configuration of an antenna device as a first embodiment of the present invention.
Figure 2B:
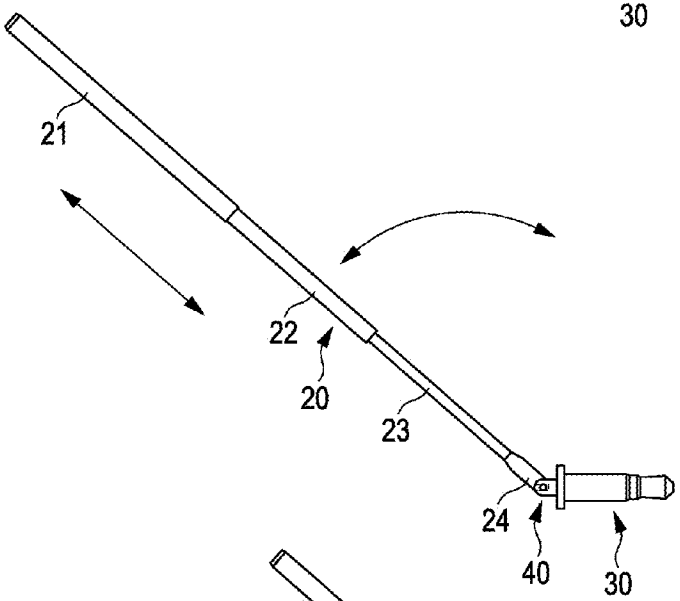
Figure 2C:
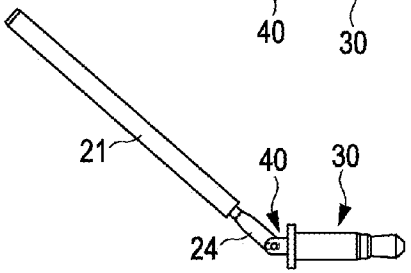

FIG. 1A and FIG. 1B are diagrams illustrating an exemplary configuration of an antenna device as a first embodiment of the present invention and represent different states of the antenna device, respectively. Specifically, FIG. 1A shows that the antenna device is fully elongated and FIG. 1B shows that the antenna device is retracted. Furthermore, FIGS. 2A to 2C are diagrams illustrating an exemplary configuration of an antenna device as a first embodiment of the present invention and represent different states of the antenna device, respectively. Specifically, FIG. 2A shows that the antenna device is fully extended, FIG. 2B shows that the antenna device is elongated in a rotatable manner, and FIG. 2C shows that the antenna device is retracted in a rotatable manner.

The antenna device 10 of the first embodiment includes a retractable rod antenna element 20, a disk-shaped, round plug 30 removably fit in a round jack arranged in an electronic apparatus, such as a mobile communication apparatus. The details of the round jack will be described later.

The antenna device 10 is formed as a rod antenna at (¼)λ of the UHF band in extension and designed for reception of television signals at the UHF band (470 MHz to 890 MHz). In contrast, the antenna device 10 is approximately 110 mm in length (indicated by the arrow "A" in the figure). Specifically, for example, it may be 113.5 mm in length (A). The maximum extended length of the rod antenna element 20, which is indicated by the arrow "B" in the figure, may be 97 mm. The length of the round plug 30 may be 16.5 mm.

[Configuration of Antenna Device]

The rod antenna element 20 may be composed of metal pipes with different diameters. The rod antenna element 20 may be designed to be telescopic in multiple stages, for example in three stages. In the figure, the rod antenna element 20 includes a first rod 21, a second rod 22, a third rod 23, and a connection part 24 formed as an extended portion on one end of the third rod 23 and connected to a rotation mechanism section 40. In this example, these structural components have different diameters. For example, the first rod 21 has a diameter (φ) of 2.7 mm, the second rod has a diameter (φ) of 2.1 mm, and the third rod 23 has a diameter (φ) of 1.15 mm. In this telescopic rod antenna element 20, the first rod 21 can house the second rod 22 alone or the second rod in which the third rod 23 has already housed as shown in FIG. 1B. In the retracted state shown in FIG. 1B, the rod antenna element 20 is 41 mm in length. The configuration of the connection part 24 of the rod antenna element 20 will be described later together with the configuration of the rotation mechanism section 40 of the round plug 30.

The round plug 30 may be a standard plug with a standard diameter (φ) of 3.5 mm. The rotation mechanism section 40 is arranged on one end of the round plug 30 to rotatably connect to the connection part 24 of the rod antenna element 20. Thus, the configuration of the antenna device 10 according to the present embodiment allows the rod antenna element 20 to be telescopic and realizes a bending mechanism to hold the rod antenna element 20 at a certain angle, for example any angle of 0, 30, 60, 90, 120, 150, and 180 degrees, by the rotation mechanism section 40.

Figure 3B:
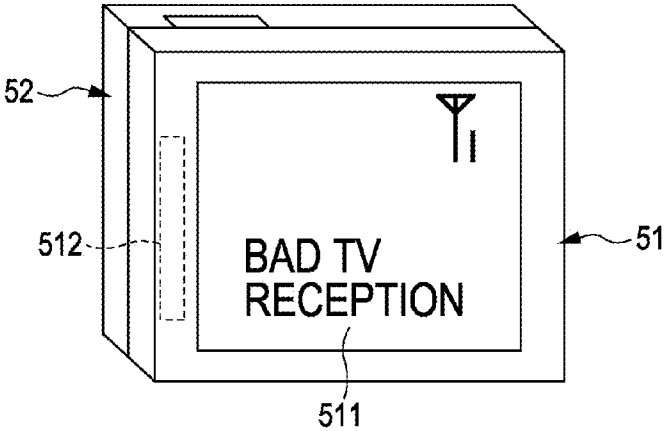
FIG. 3A and FIG. 3B are diagrams illustrating an exemplary configuration of an electronic apparatus with a built-in antenna.
Figure 3A:
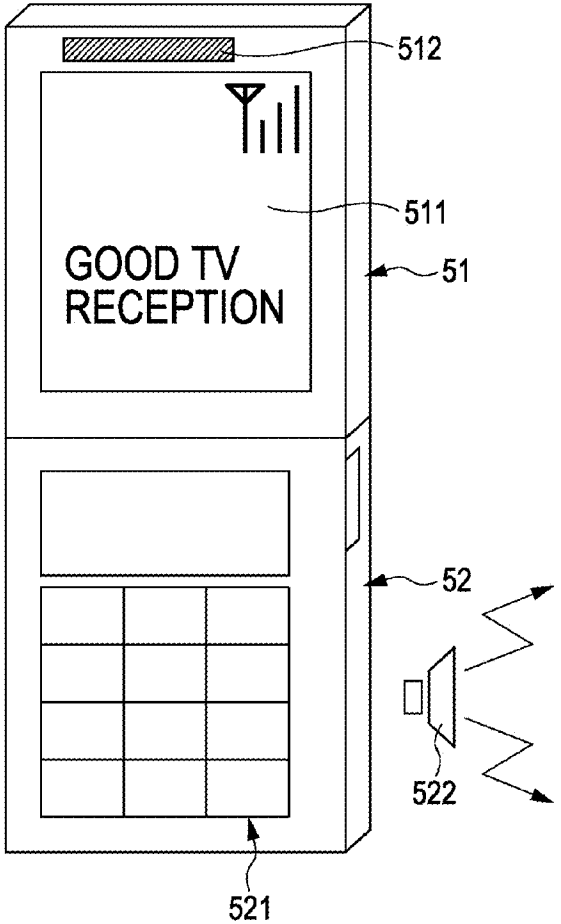
Figure 4B:
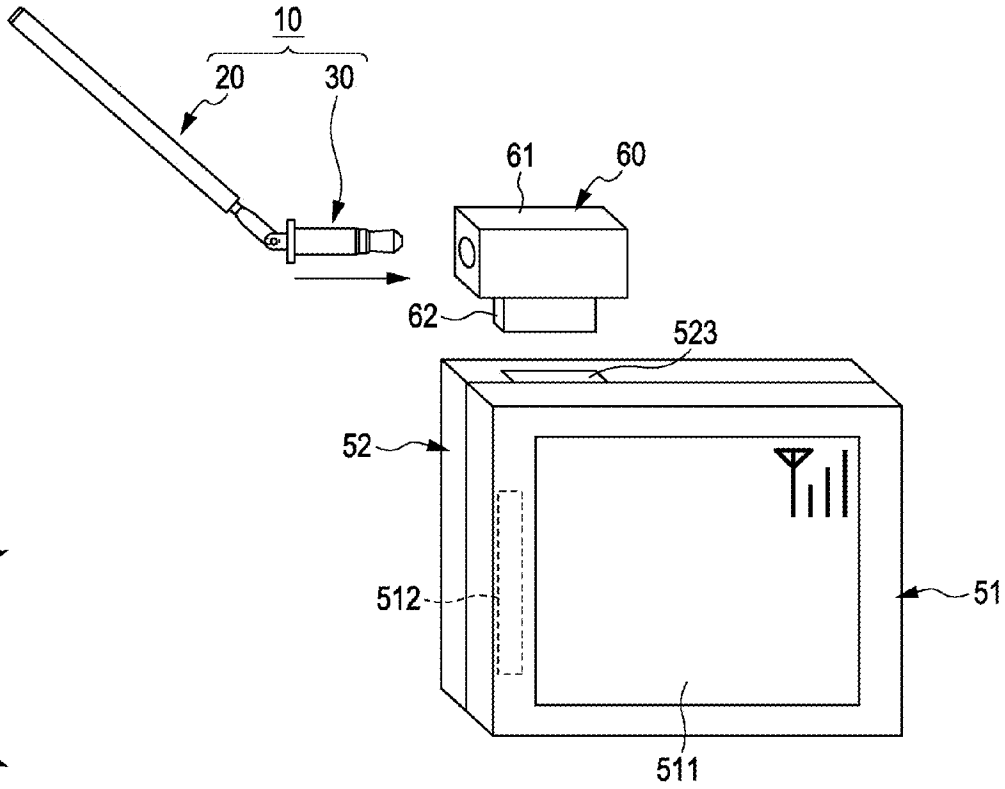
FIG. 4A and FIG. 4B are diagrams illustrating a receiving system (receiver) according to an embodiment of the present invention, where the receiving system includes a cell phone as an example of an electronic apparatus having a built-in antenna.
Figure 4A:
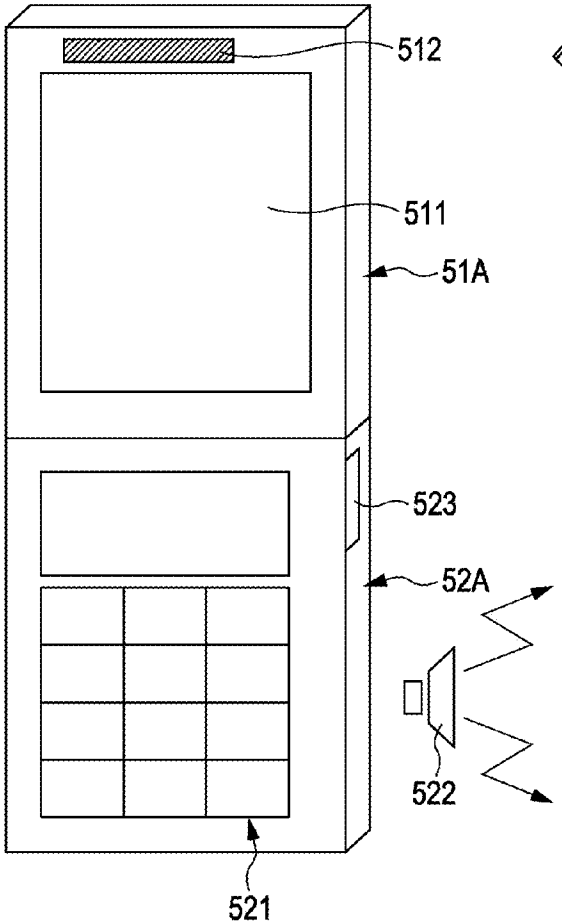

In this embodiment, the antenna device 10 may be provided as a removable one to be easily realized as an ideal antenna device when the receiving performance of an electronic apparatus is deteriorated as described below. FIG. 3A and FIG. 3B are diagrams illustrating a typical cell phone as an example of an electronic apparatus with a built-in antenna. Specifically, FIG. 3A shows an unfolded (opened) state and FIG. 3B shows a folded (closed) state. FIG. 4A and FIG. 4B are diagrams illustrating a receiving system (receiver) according to an embodiment of the present invention, where the receiver includes a cell phone as an exemplary electronic apparatus with the built-in antenna. Specifically, FIG. 4A shows an unfolded (opened) state and FIG. 4B shows a folded (closed) state.

As shown in FIG. 3A and FIG. 3B, a foldable cell phone 50 includes a first housing member 51 and a second housing member 52 coupled with each other by a hinge mechanism (not shown) so that the cell phone 50 can be folded. The first housing member 51 includes a display section 511, such as a liquid crystal display, on the front side thereof and a built-in antenna 512 in the inside thereof. The second housing member 52 includes a key operation section 521 on the front side thereof and a built-in speaker 522 in the inside thereof.

In the case of installing a rod antenna in such a cell phone 50, an additional space is necessary in the body. Thus, the configuration of the cell phone 50 can be more complicated. As previously mentioned, one-segment broadcasting has been started recently and some of mobile communication apparatuses, such as cell phones and mobile terminal devices, are configured to receive the one-segment broadcasting. In any of these apparatuses, the use of rod antenna leads to an increase in size of the set and complexes the configuration thereof.

As a measure against such matters, built-in antenna technologies and so on have been developed and such antennas have been mounted more and more. However, in some cases, the performance of the antenna can be deteriorated depending on the state of use. For example, as shown in FIG. 3A, the antenna shows good performance when the foldable cell phone 50 is used in an unfolded state. However, when the cell phone 50 is used in a folded state as shown in FIG. 3B, the built-in antenna 512 comes close to the ground GND of the set to cause a decrease in ground size. As a result, the characteristic (gain) of the built-in antenna 512 can be extensively deteriorated. For example, it decreases 10 dB or more. If the apparatus is used in hand, the built-in antenna can be hidden by the hand and the receiver sensitivity thereof can be decreased.

According to the present embodiment, the rod-shaped, removable antenna device 10 with a standard round plug 30 as shown in any of FIGS. 1A and 1B, FIGS. 2A to 2C, and FIGS. 4A and 4B is provided for a conversion adaptor 60 to easily realize an ideal antenna device when the performance degradation of the antenna occurs. Thus, a good receiving condition can be assured by employing the removable rod antenna device 10 according to the present embodiment. The cell phone device 50A shown in FIG. 4A and FIG. 4B is configured to have a first housing 51A and a second housing 52A which can be folded together by a hinge mechanism (not shown). The first housing member 51A includes a display section 511, such as a liquid crystal display, on the front side thereof and a built-in antenna 512 in the inside thereof. The second housing member 52A includes a key operation section 521 on the front side thereof and a built-in speaker 522 in the inside thereof. In addition, a flat-type jack 523 is formed on one lateral size of the second housing member 52A and connectable to the conversion adaptor 60.

The conversion adaptor 60 includes a round jack 61 to which the round plug 30 of the antenna device 10 can be connected and a flat plug 62 to be connected to the flat jack 523 of the cell phone 50A.

The round plug 30 of the antenna device 10 according to the first embodiment can be easily formed by machining the portion of the antenna device 10 to be connected and fixed to the electronic apparatus of the normal set.

FIGS. 5A to 5D are diagrams illustrating the structure of the round plug of the antenna device 10 according to the first embodiment and the process of forming the same. In these figures, different steps of the process are shown.

Figure 5D:
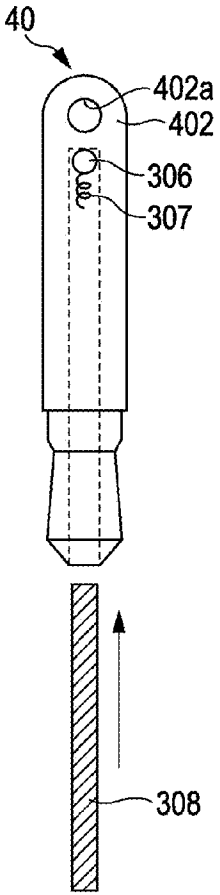
FIGS. 5A to 5D are diagrams illustrating the structure of the round plug of the antenna device according to the first embodiment and the process of forming the same.
Figure 5C:
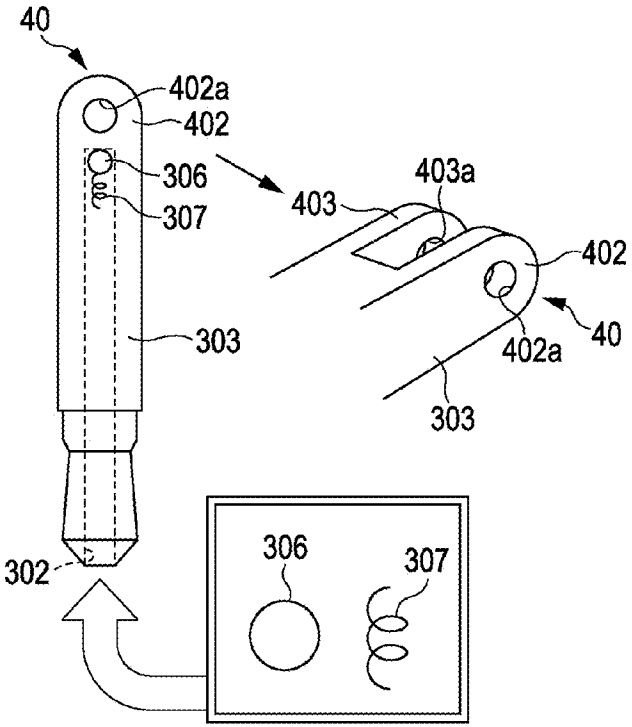
Figure 5B:
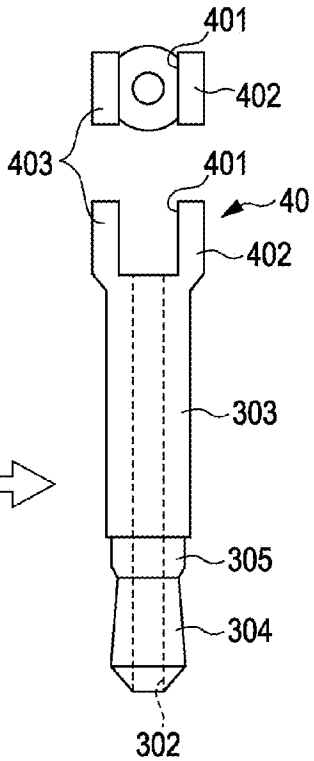
Figure 5A:
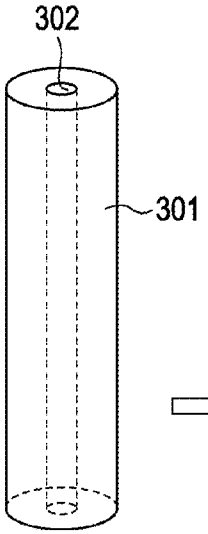

For forming the round plug 30, as shown in FIG. 5A, a cylindrical metal pipe 301 is prepared first. Then, a through hole 302 is concentrically formed along the central axis of the cylindrical metal pipe 301.

As shown in FIG. 5B, for example, the profile of the metal pipe 301 is machined into a 3.5-mm round plug (JIS C6560). That is, for example, a pseudo sleeve portion 303 is formed on the base side and a tip portion 304 is formed on the end side. In addition, a ring portion 305 is formed between the sleeve portion 303 and the tip portion 304.

Part of the rotation mechanism section 40 to be connected to the connection part 24 of the rod antenna element 20 is formed on one end of the sleeve portion 303. Specifically, the central part of the one end side of the sleeve portion 303 is machined to form a notch-shaped housing portion 401 for housing a lock tip portion of the connection part 24, where lock notches are formed, to rotatably hold the connection part 24. In this case, the through hole 302 is formed passing through the sleeve portion 303 from the free end of the tip portion 304 to the bottom of the housing portion 401. Furthermore, the housing portion 401 is constructed of plate-shaped flanges 402 and 403 which are formed on two opposite edge portions to rotatably hold or pivotably support the lock tip portion. The rotation mechanism section 40 is formed so that the lock tip portion of the connection part 24 housed in and pivotably supported by the housing portion 401 is rotatable within a certain restricted range of angles in two opposite directions free of the flanges 402 and 403 of the housing portion 401. Pivotal support holes 402*a* and 403*a* are respectively formed in the flanges 402 and 403 to pivotably support the lock tip portion of the connection part 24 with a washer pin. In addition, the outer edge portions of the respective flanges 402 and 403 are formed in arc.

Next, as shown in FIG. 5C, a ball 306 and a coil spring 307 are inserted into the through hole 302 from the tip portion 304 and then wedged therein by placing a spring-fixing pin 308 into the through hole 302. Here, the spring-fixing pin 308 has substantially the same diameter as that of the hole 302.

Alternatively, the machining may be performed after the steps of inserting the ball 306 and the spring 307 into the hole 302 and wedging them into the hole 302 by the pin 308.

Both the ball 306 and the spring 307 can be functioned as components of the rotation mechanism section 40.

Subsequently, the connection part 24 of the telescopic rod antenna element 20 and the rotation mechanism section 40 are connected to each other using the washer pin, thereby completing the process.

FIG. 6A to 6E illustrate an example of the lock mechanism and the connection between the connection portion and the round plug of the rod antenna element according to the first embodiment.

Figures 6A, 6B, 6C, 6D, 6E:
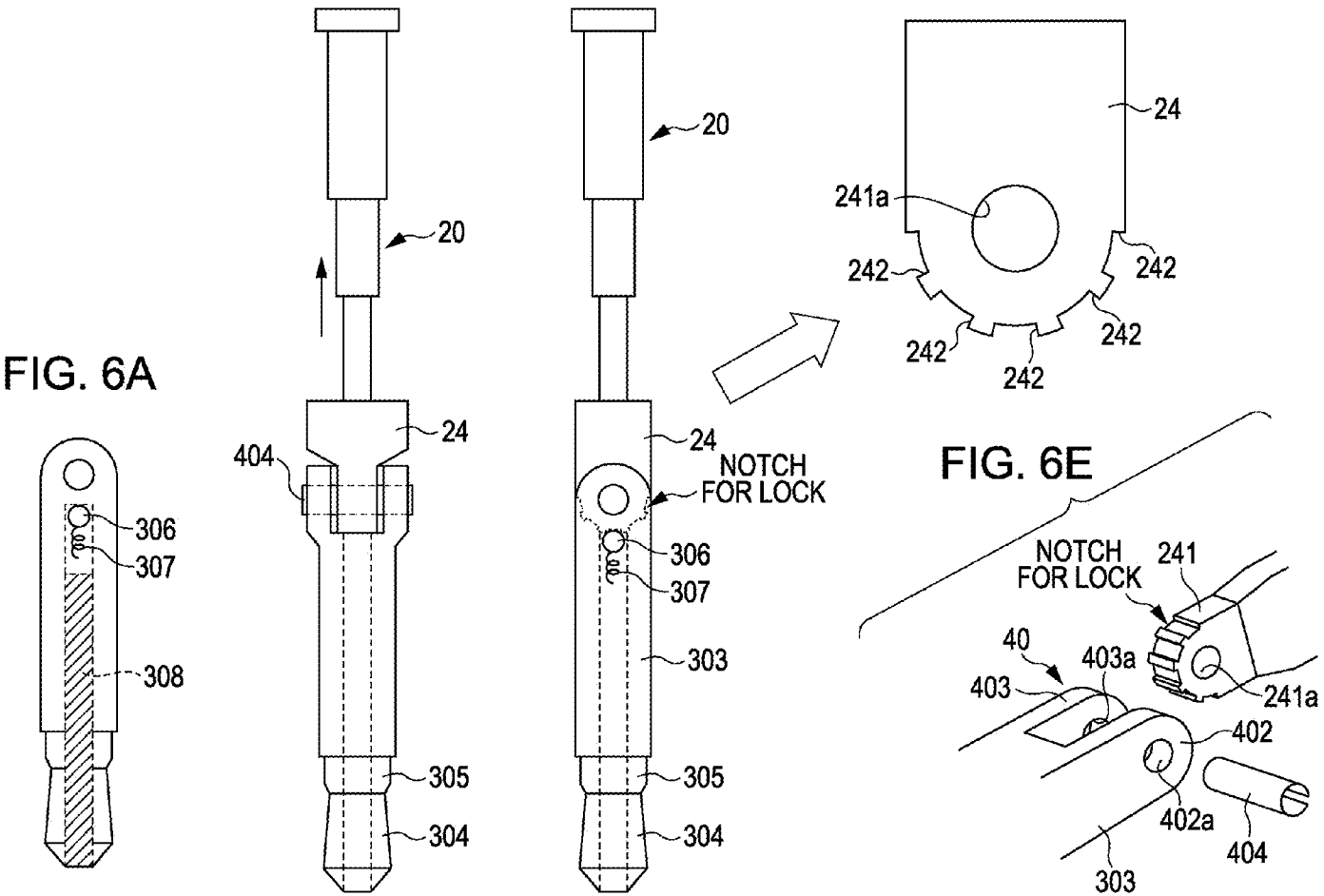
FIGS. 6A to 6E are diagrams illustrating an example of the lock mechanism and the connection between the connection portion and the round plug of the rod antenna element according to the embodiment of the present invention.

FIG. 6A illustrates the configuration of the sleeve portion 303 in which the ball 306, the spring 307, and the spring-fixing pin 308 are arranged in place. FIG. 6B illustrates the connection between the sleeve portion 303 and the connection portion 24 of the retractable rod antenna 20 which can extend in the direction indicated by the arrow in the figure, where these components are rotatably fixed using the washer pin 404. As shown in FIG. 6C to FIG. 6E, the lock tip portion 241 is formed on the connection portion 24 of the rod antenna element 20 and capable of being housed in the housing portion 401 of the rotation mechanism section 40 formed on one end of the round plug 30. A plurality of notches 242 is formed in the arc-shaped edge of the lock tip portion 241 and arranged spaced at angular intervals corresponding to the predetermined rotation angles of the lock tip portion 241 to allow the ball 306 to fit into any of the notches 242. The pivotal support hole 241*a* is formed in the lock tip portion 241 so that the lock tip portion 241 can be integrally, pivotally supported by the pivotal support holes 402*a* and 403*a* formed in the flanges 402 and 403 of the rotation mechanism section 40.

The lock tip portion 241 of the connection portion 24 as configured above is arranged in the housing portion 401 so that the pivotal support hole 241*a* can face to the pivotal support holes 402*a* and 403*a* in the flanges 402 and 403 of the rotation mechanism section 40. Subsequently, the washer pin 404 is inserted into the pivotal support holes 402*a*, 241*a*, and 403*a* and then fixed therein. Thus, the rod antenna element 20 is attached to the round plug 30, so that it can rotate around the lock tip portion 241. The ball 306 placed in the through hole 302 of the round plug 30 is pushed toward the lock tip portion 241 of the housing 401 by the resilience of the spring 307 and pushed against the notch 242. Therefore, the rod antenna device is provided with a plurality of locking portions where the rod antenna element 20 can be locked at one of the notches 242. Furthermore, such a locked state can be released by applying a force against the force of locking the ball 306 and the notch 242 and the antenna element 20 can be then allowed to freely rotate while allowing the ball 306 to be locked into another notch 242.

Figure 7:
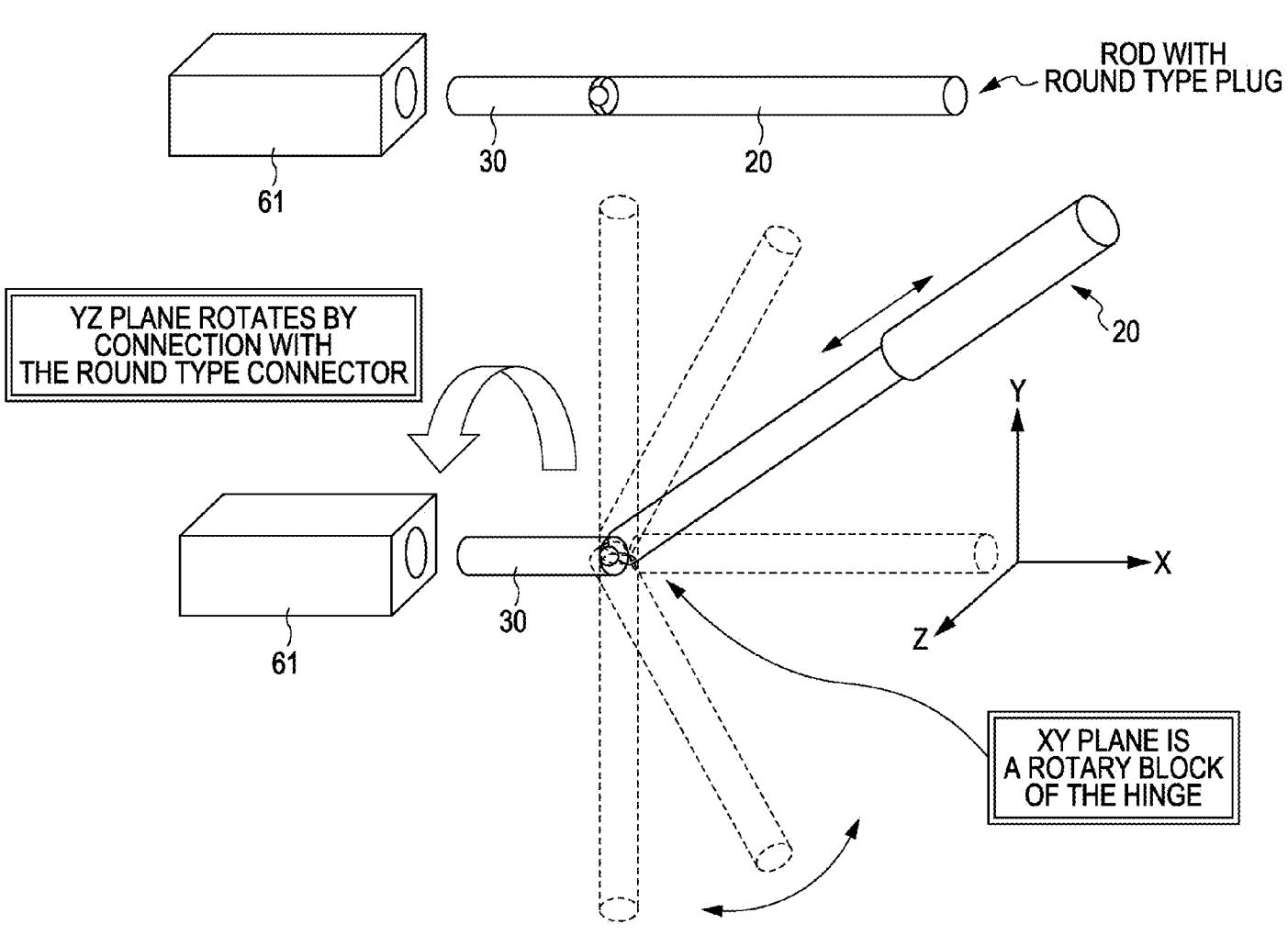
FIG. 7 is a schematic diagram illustrating the rotation mechanism with the round plug and the round jack according to the embodiment of the present invention.

FIG. 7 is a schematic diagram illustrating the rotation mechanism with the round plug 30 and the round jack 61, which can be connected to each other, according to the embodiment of the present invention. In the upper part of the figure, the round plug 30 and the rod antenna element 20 are arranged in straight. In the lower part of the figure, the antenna element 20 is rotated around the round plug 30.

In the present embodiment, the use of the round plug 30 and the round jack 61 leads to a great advantage in rotation mechanism. That is, in the rectangular coordinate system defined for the rotation mechanism in FIG. 7, the rotational movement of the antenna element 20 in the X-Y direction can be realized using the rotation mechanism section 40 of the round plug 30 of the present embodiment. The rotational movement of the antenna element 20 in the X-Y direction is restricted by the hinge in the rotation mechanism section 40. In contrast, the rotational movement of the antenna element 20 in the Y-Z direction can be easily realized because of the round plug 30 can slidably rotate around the X axis of the rectangular coordinate system without restriction.

In other words, it is necessary for the antenna device 10 to have the unidirectional rotation mechanism (XY plane).

In contrast, the other rotation mechanism (YZ plane) can be attained by the connection between the round plug 30 and the round jack 61. Thus, the entire rotation mechanism of the antenna device 10 itself can be prevented from complication.

According to the present embodiment, as described above, the rod-shaped, removable antenna device 10 as shown in any of FIGS. 1A and 1B, FIGS. 2A to 2C, and FIGS. 4A and 4B are provided for the conversion adaptor 60 with the standard round jack 61 to easily realize an ideal antenna device when the performance degradation of the antenna occurs.

2. Second Embodiment

Figure 8:
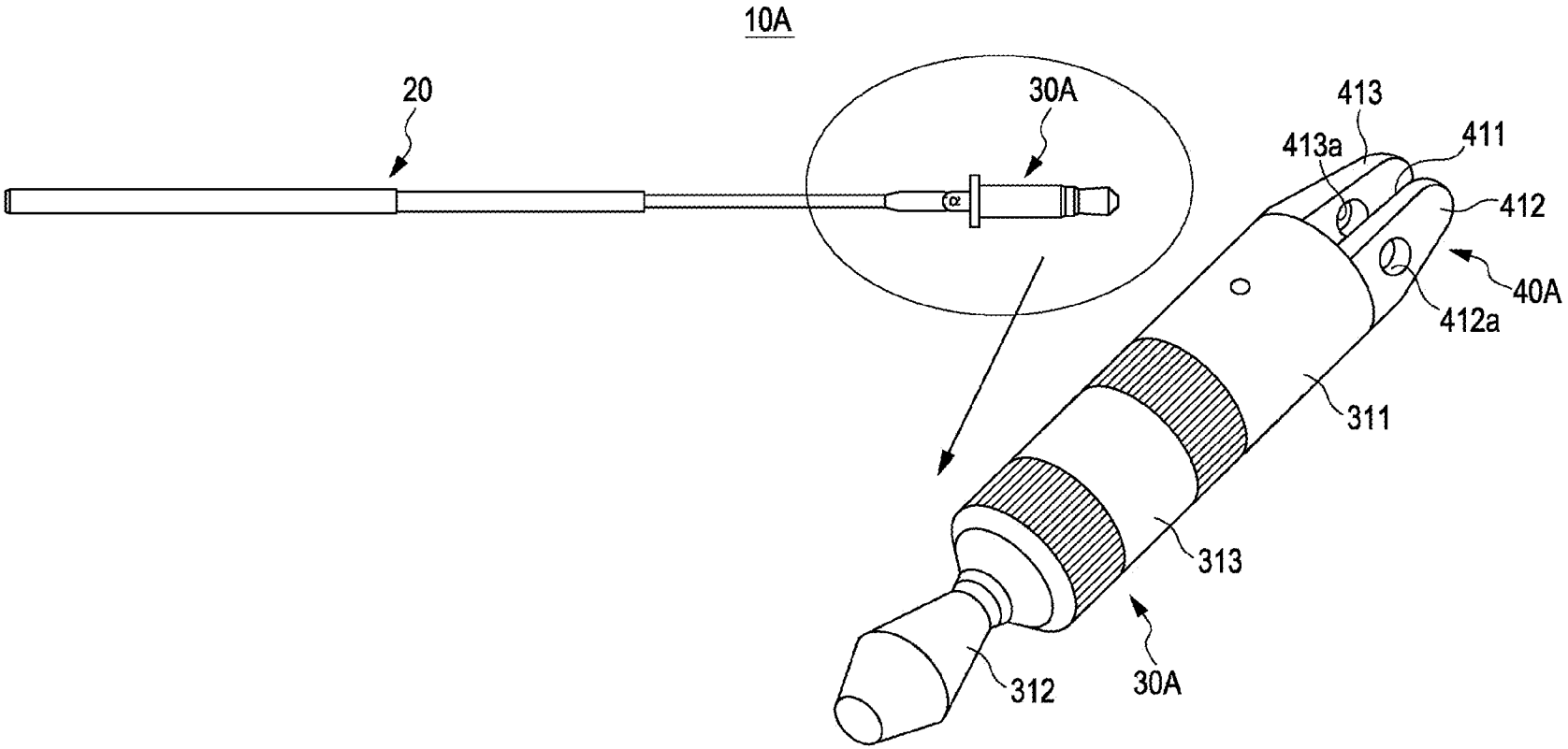
FIG. 8 is a diagram illustrating an exemplary configuration of an antenna device as a second embodiment of the present invention.

FIG. 8 is a diagram illustrating an exemplary configuration of an antenna device as a second embodiment of the present invention.

The antenna device 10A of the second embodiment has the same configuration as that of the first embodiment, with the exception that a round type plug 30A is formed as a multipole plug.

A ground sleeve portion 311 or the like is fundamentally formed on the base side of the round multipole plug 30A. A tip portion 312 for signal or left channel is formed on the end side of the plug 30A. An insulated ring portion 313 for right channel is formed between the sleeve portion 311 and the tip portion 312. Part of the rotation mechanism section 40A to be connected to the connection part 24 of the rod antenna element 20 is formed on one end of the sleeve portion 311.

The round multipole plug 30A of the antenna device 10A according to the second embodiment can be easily formed by machining the portion of the antenna device 10A to be connected to the electronic apparatus of the normal set.

Figure 9A:
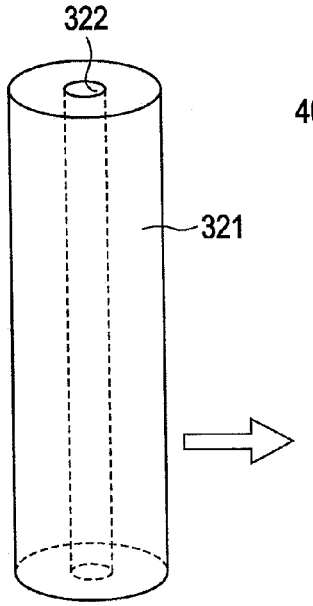
FIGS. 9A to 9C are diagrams illustrating the structure of the round plug of the antenna device according to the second embodiment and the process of forming the same.
Figure 9B:
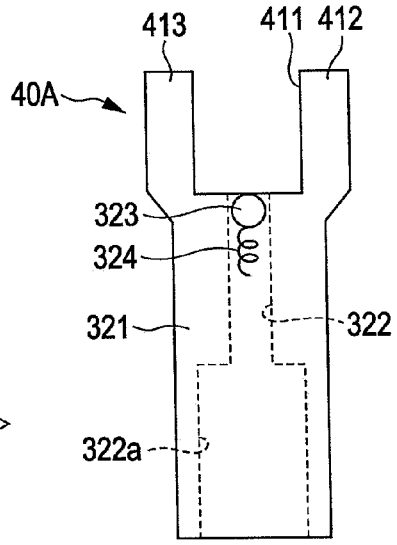
Figure 9C:
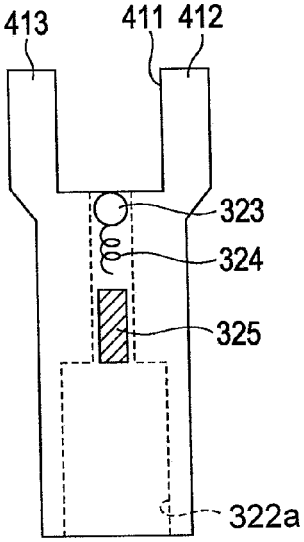

FIGS. 9A to 9C are diagrams illustrating the structure of the round plug of the antenna device 10A according to the second embodiment and the process of forming the same, where FIGS. 9A to 9C illustrate the respective steps of the process.

For forming the sleeve portion 311 of the round plug 30A, as shown in FIG. 9A, a cylindrical metal pipe 321 is prepared first. Then, a through hole 322 is concentrically formed along the central axis of the cylindrical metal pipe 321. As shown in FIG. 9B, for example, the profile of the metal pipe 321 is machined into a 3.5-mm round multipole plug (three poles). Part of the rotation mechanism section 40A to be connected to the connection part 24 of the rod antenna element 20 is formed on one end of the sleeve portion 311. Furthermore, the through hole 322 of the sleeve portion 311 has a large-sized region extending from the middle portion to the other end, which is provided as a resin-injection hole 322*a* to inject resin into the through hole 322.

Figure 10B:
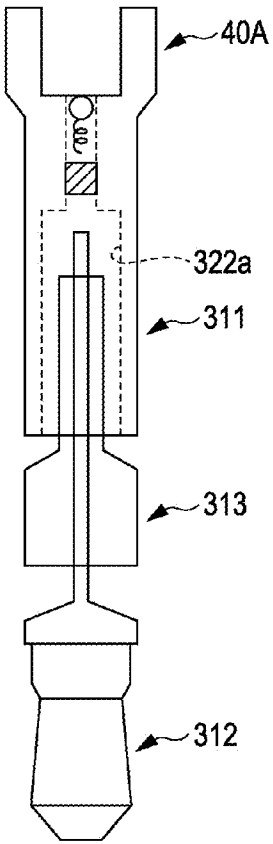
FIG. 10A and FIG. 10B are first diagrams illustrating the structure of the round multipole plug of the antenna device according to the second embodiment and the process of forming the same.
Figure 10A:
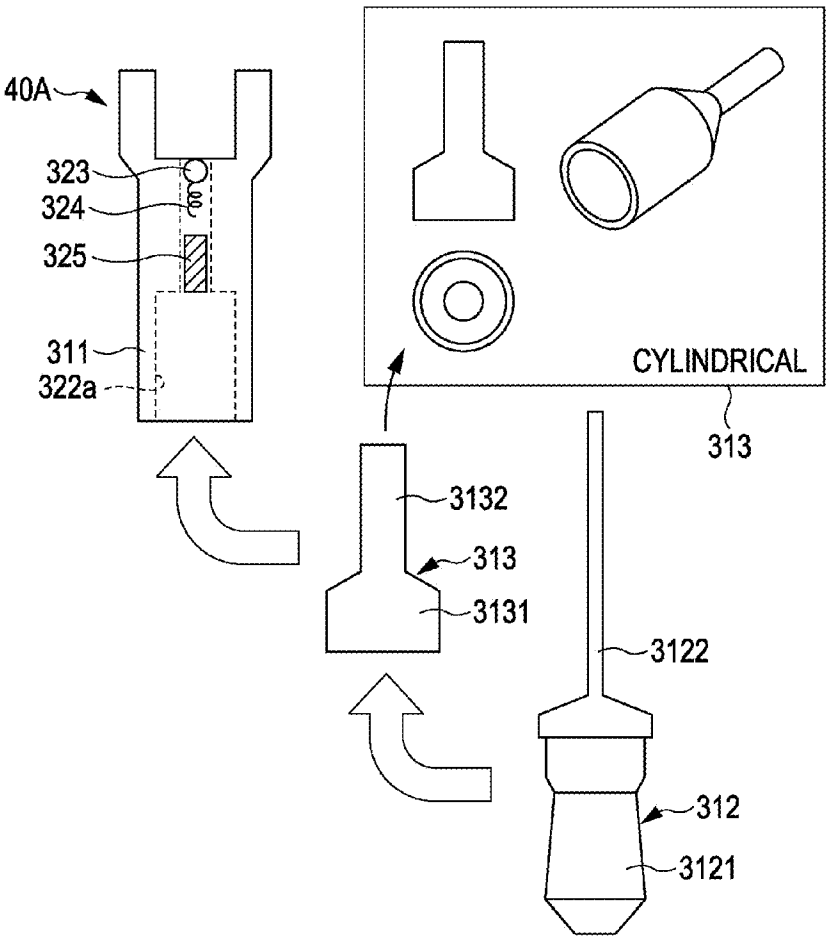

Specifically, the central part of the one end side of the sleeve portion 311 is machined to form a notch-shaped housing portion 411 in the rotation mechanism section 40A. The notch-shaped housing portion 411 is responsible for housing a lock tip portion 241 of the connection part 24, where lock notches are formed, to rotatably hold the connection part 24. In this case, the through hole 322 and the resin-injection hole 322*a* are formed passing through the sleeve portion 311 from the end thereof to the bottom of the housing portion 411. Furthermore, the housing portion 411 is constructed of plate-shaped flanges 412 and 413 which are formed on two opposite edge portions to rotatably hold or pivotably support the lock tip portion 241. The rotation mechanism section 40A is formed so that the lock tip portion 241 of the connection part 24 housed in and pivotably supported by the housing portion 411 is rotatable within a certain restricted range of angles in two opposite directions free of the flanges 412 and 413 of the housing portion 411. As shown in FIG. 10A and FIG. 10B, pivotal support holes 412*a* and 413*a* are respectively formed in the flanges 412 and 413. These pivotal support holes 412*a* and 413*a* pivotally support the lock tip portion of the connection part 24 with a washer pin. In addition, the outer edge portions of the respective flanges 412 and 413 are formed in arc.

Next as shown in FIG. 9B and FIG. 9C, a ball 323 and a coil spring 324 are inserted into the through hole 322 and then wedged therein by placing a spring-fixing pin 325 into the through hole 322. Here, the spring-fixing pin 325 has substantially the same diameter as that of the hole 322.

Alternatively, the machining may be performed after the steps of inserting the ball 323 and the spring 324 into the hole 322 and wedging them into the hole 322 by the pin 325.

Both the ball 323 and the spring 324 can be functioned as components of the rotation mechanism section 40A.

Figures 11A, 11B, 11C, 11D:
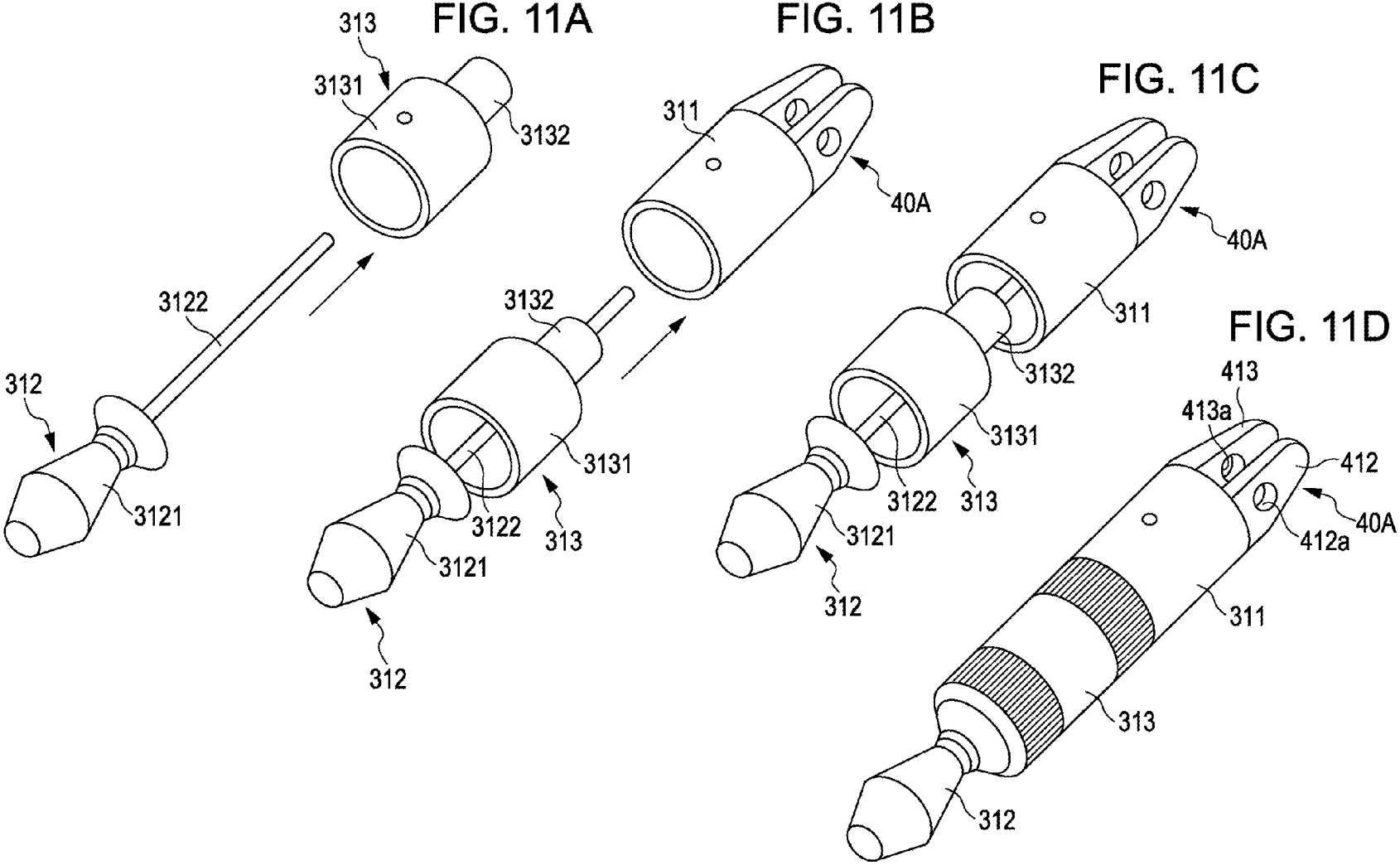
FIGS. 11A to 11D are second diagrams illustrating the structure of the round multipole plug of the antenna device according to the second embodiment and the process of forming the same.
Figure 12A:
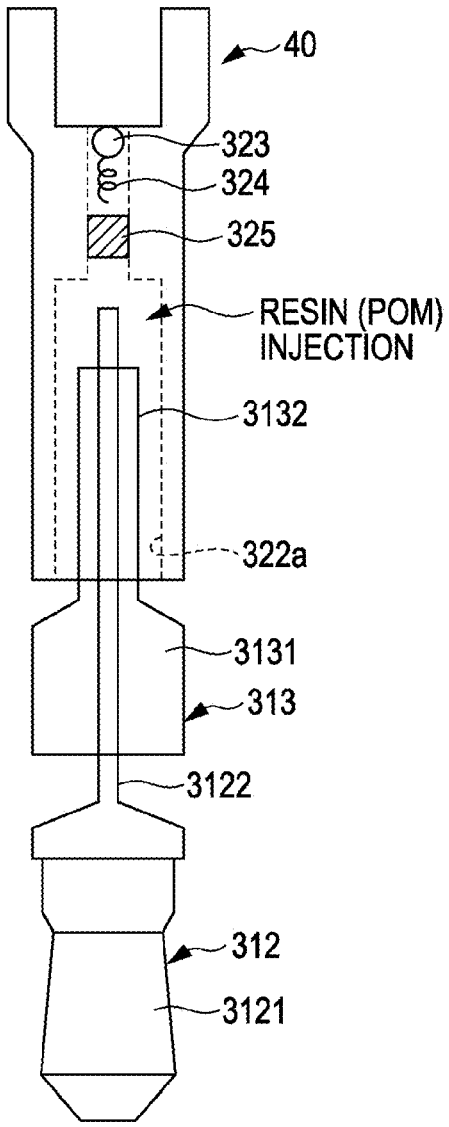
FIG. 12A and FIG. 12B are third diagrams illustrating the structure of the round multipole plug of the antenna device according to the second embodiment and the process of forming the same.
Figure 12B:
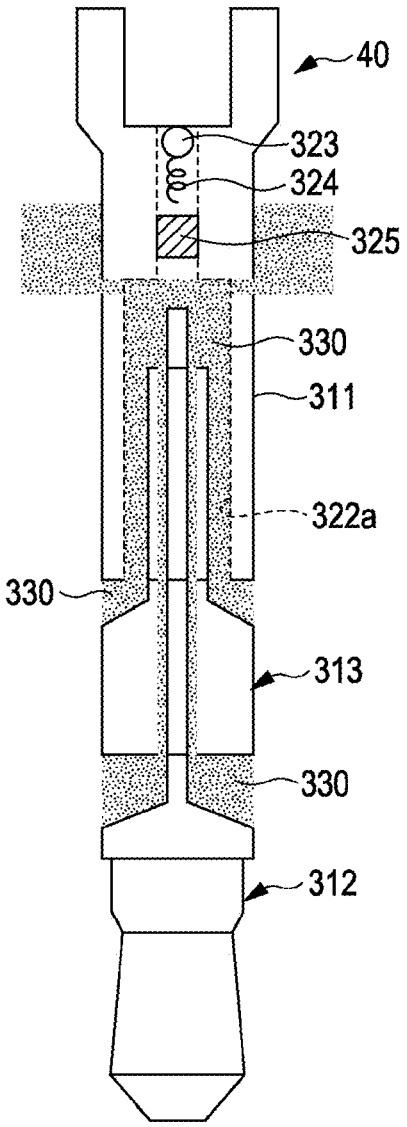

FIG. 10A and FIG. 10B are first diagrams illustrating the structure of the round multipole plug of the antenna device 10 according to the second embodiment and the process of assembling the round multipole plug. In FIG. 10A and FIG. 10B, different steps of the process are shown. FIGS. 11A to 11D are second diagrams illustrating the process of assembling the round multipole plug of the antenna device 10 according to the second embodiment. Specifically, FIGS. 11A to 11D illustrate different steps of the process, respectively. FIGS. 12A and 12B are third diagrams illustrating the process of assembling the round multipole plug of the antenna device 10 according to the second embodiment. In FIG. 12A and FIG. 12B, the respective steps of the process are shown.

As shown in any of these figures, the ring portion 313 includes a cylindrical main body 3131 and an inserter 3132 with a diameter smaller than that of the main body 3131, where a through hole is opened from one end of the inserter 3132 to the underside of the main body 3131. In addition, the tip portion 312 includes a cylindrical main body 3121 and an inserter 3122 with a diameter smaller than that of the main body 3121, where a through hole is opened from one end of the inserter 3122 to the underside of the main body 3121. For example, the inserter 3122 of the tip portion 312 is inserted into the ring portion 313 from the main body 3131 and both the inserter 3122 of the tip portion 312 and the inserter 3132 of the ring portion 313 are inserted into the resin-injection hole 322*a* from the other end of the sleeve portion 311. In this case, the assembled round multipole plug 30A is one shown in FIG. 10B and FIG. 12A. Subsequently, as shown in FIG. 12B, resin (e.g., POM) 330 is injected into the resin-injection hole 322*a* and so on to form a round multipole plug 30A as shown in FIG. 11D.

In this way, the sleeve portion 311 is formed on the base side and the tip portion 312 is formed on the end side. In addition, the insulated ring portion 313 is formed between the sleeve portion 311 and the tip portion 312.

FIGS. 13A to 13E illustrate an example of the lock mechanism and the connection between the connection portion and the round plug of the rod antenna element according to the second embodiment. In this case, the configuration of the connection portion is similar to one illustrated in FIGS. 6A to 6E. Thus, the same structural elements as those in FIGS. 6A to 6E are designated by the same reference numerals.

Figures 13A, 13B, 13C, 13D, 13E:
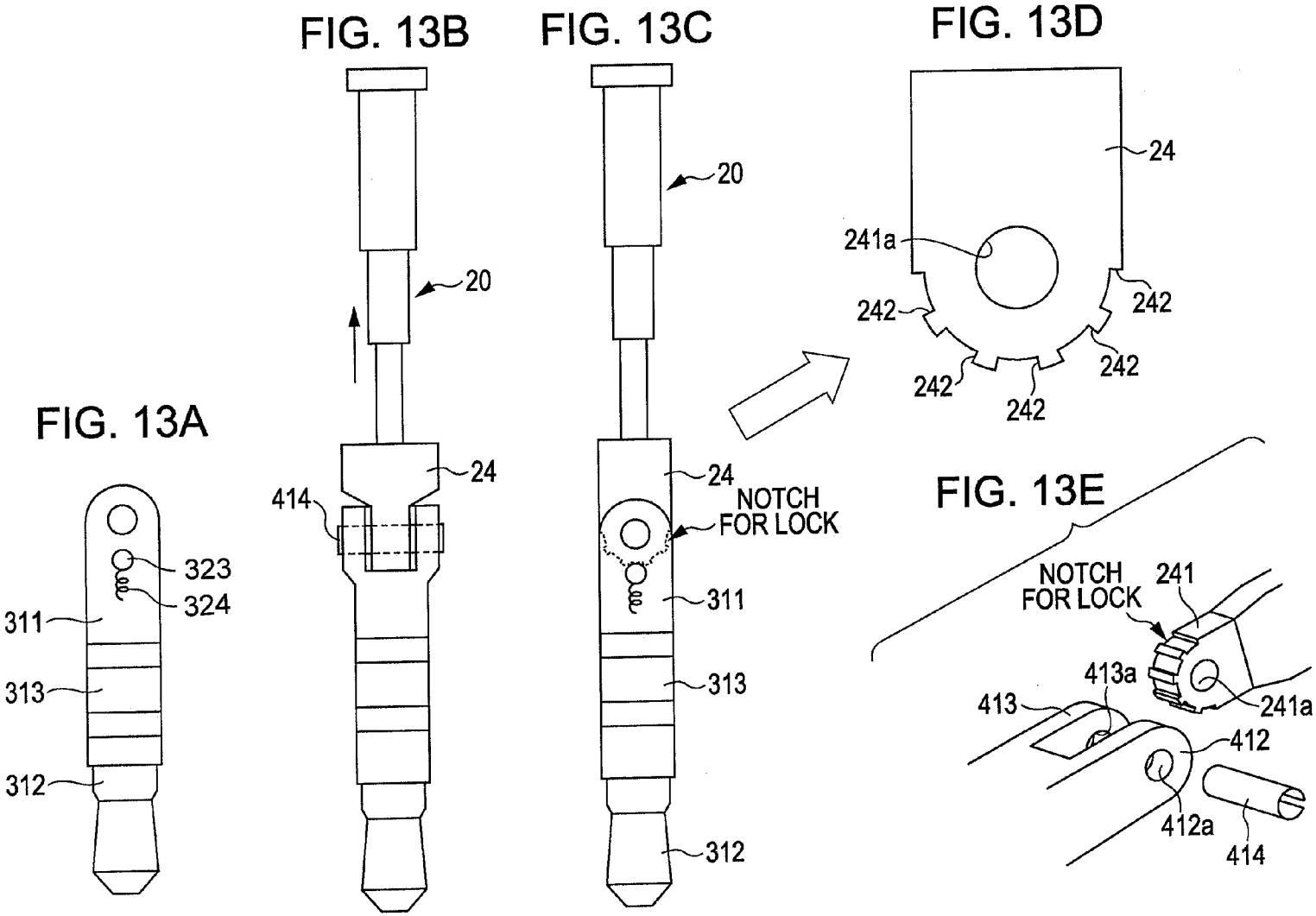
FIGS. 13A to 13E are diagrams illustrates an example of the lock mechanism and the connection between the connection portion and the round plug of the rod antenna element according to the second embodiment.

As shown in FIG. 13C to FIG. 13E, the lock tip portion 241 is formed on the connection portion 24 of the rod antenna element 20 and capable of being housed in the housing portion 411 of the rotation mechanism section 40A formed on one end of the round plug 30A. A plurality of notches 242 is formed in the arc-shaped edge of the lock tip portion 241 and arranged spaced at angular intervals corresponding to the predetermined rotation angles of the lock tip portion 241 to allow the ball 323 to fit into any of the notches 242. The pivotal support hole 241*a* is formed in the lock tip portion 241 so that the lock tip portion 241 can be integrally, pivotally supported by the pivotal support holes 412*a* and 413*a* formed in the flanges 412 and 413 of the rotation mechanism section 40A.

The lock tip portion 241 of the connection portion 24 as configured above is arranged in the housing portion 411 so that the pivotal support hole 241*a* can face to the pivotal support holes 412*a* and 413*a* in the flanges 412 and 413 of the rotation mechanism section 40A. Subsequently, the washer pin 414 is inserted into the pivotal support holes 412*a*, 241*a*, and 413*a* and then fixed therein. Thus, the rod antenna element 20 is attached to the round plug 30A, so that it can rotate around the lock tip portion 241. The ball 323 placed in the through hole 322 of the round plug 30A is pushed toward the lock tip portion 241 of the housing 411 by the resilience of the spring 324 and pushed against the notch 242. Therefore, the rod antenna device is provided with a plurality of locking portions where the rod antenna element 20 can be locked at one of the notches 242. Furthermore, such a locked state can be released by applying a force against the force of locking the ball 323 and the notch 242 and the rod antenna element 20 can be then allowed to freely rotate while allowing the ball 323 to be locked into another notch 242.

In the second embodiment, like the one shown in FIG. 7, the use of the round plug 30A and the round jack 61 leads to a great advantage in rotation mechanism. That is, in the rectangular coordinate system defined for the rotation mechanism in FIG. 7, the rotational movement of the antenna element 20 in the X-Y direction can be realized using the rotation mechanism section 40A of the round plug 30A of the present embodiment. The rotational movement of the antenna element 20 in the X-Y direction is restricted by the hinge in the rotation mechanism section 40A. In contrast, the rotational movement of the antenna element 20 in the Y-Z direction can be easily realized because of the round plug 30A can slidably rotate around the X axis of the rectangular coordinate system without restriction. In other words, it is necessary for the antenna device 10A to have the unidirectional rotation mechanism (XY plane). In contrast, the other rotation mechanism (YZ plane) can be attained by the connection between the round plug 30A and the round jack 61. Thus, the entire rotation mechanism of the antenna device 10A itself can be prevented from complication.

3. Third Embodiment

Figure 14B:
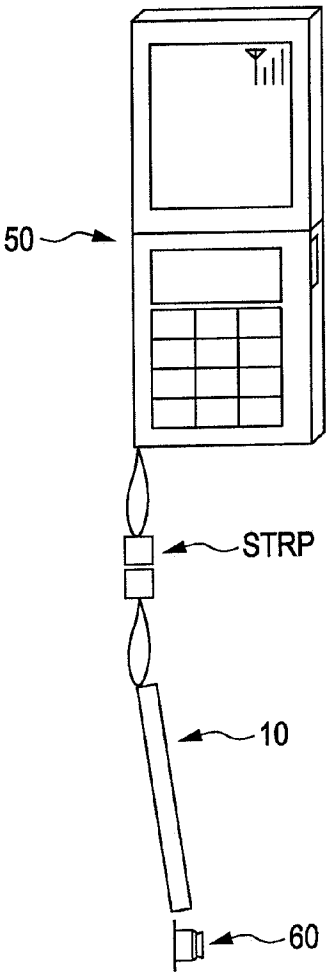
FIG. 14A and FIG. 14B are diagrams illustrating an exemplary configuration of an antenna device as a third embodiment of the present invention.
Figure 14A:
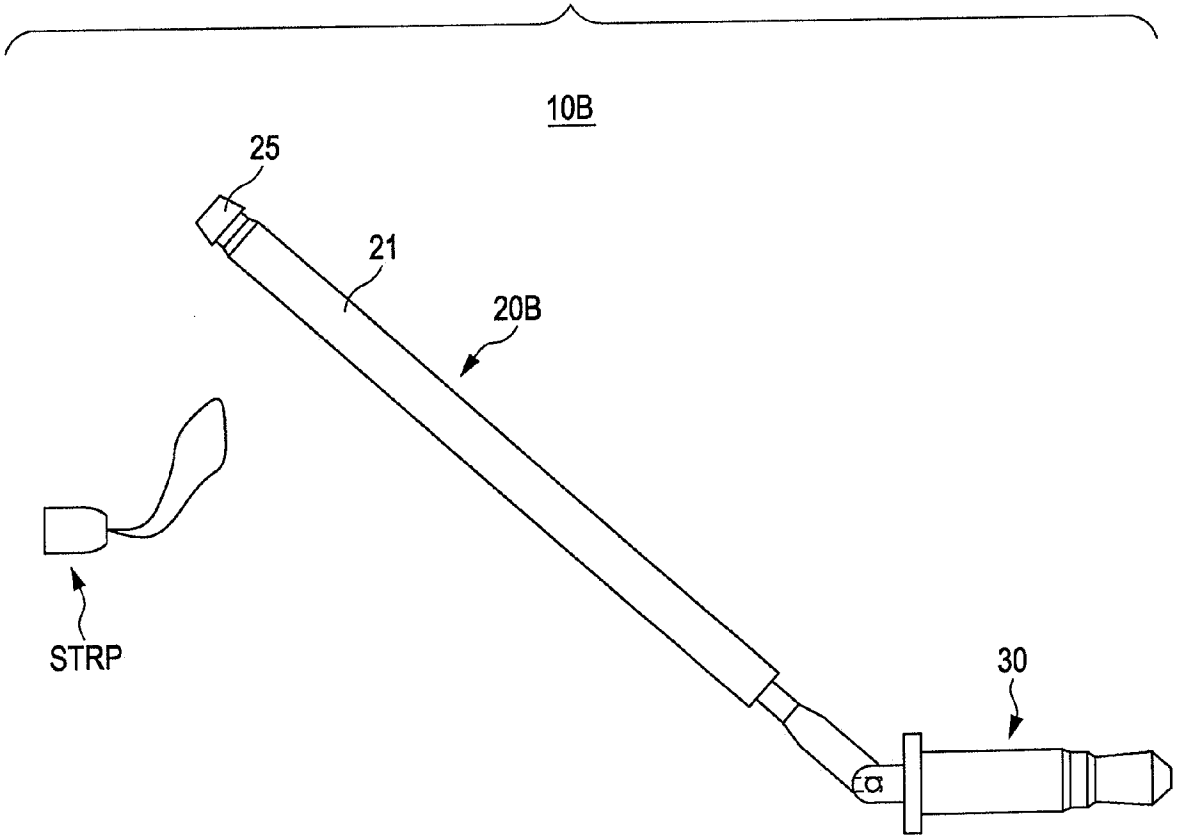

FIGS. 14A and 14B are diagrams illustrating an exemplary configuration of an antenna device as a third embodiment of the present invention. FIG. 14A and FIG. 14B represent different states of the antenna device, respectively.

The antenna device 10B of the third embodiment has the same configuration as that of the first embodiment, with the exception that a hole 25 for connecting a strap STRP is formed in the end of the rod antenna element 20B.

As shown in FIG. 14B, for example, the antenna device 10B of the present embodiment may be attached to a cell phone 50 while being attached to the conversion adaptor 60 and may be then carried using the strap STRP.

4. Fourth Embodiment

Figure 15B:
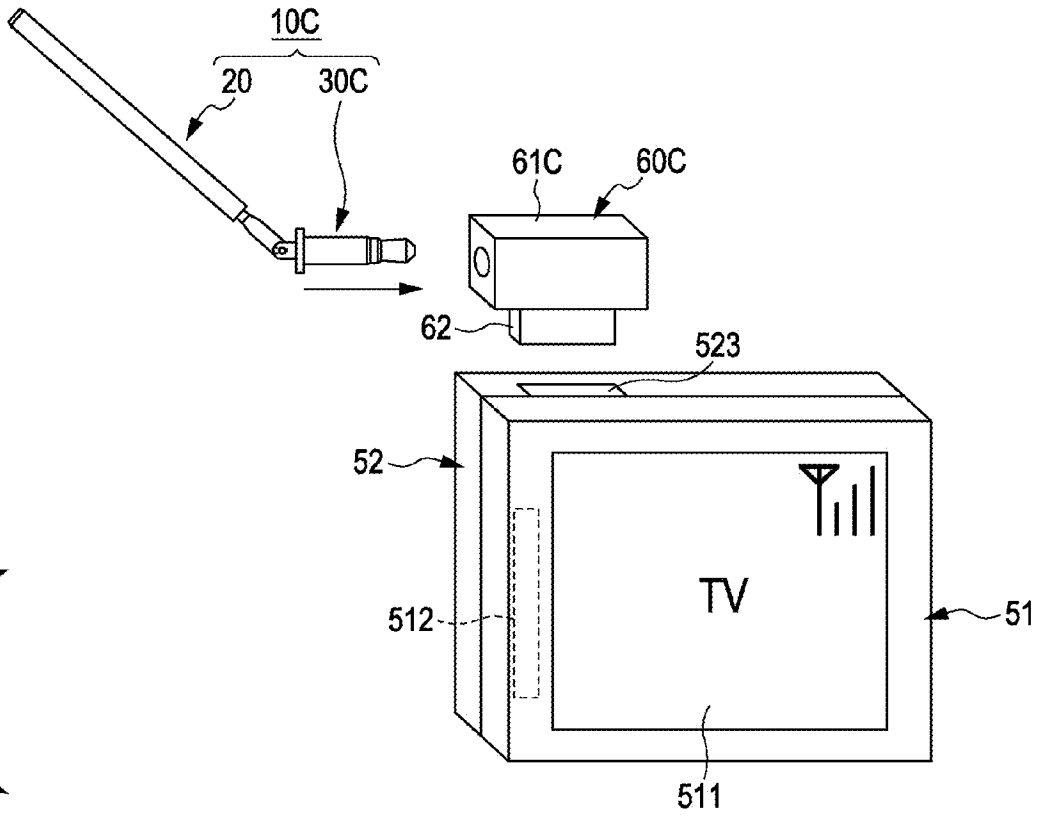
FIG. 15A and FIG. 15B are diagrams illustrating a receiving system (receiver) containing a cell phone as an example of an electronic apparatus to which an antenna device according to a fourth embodiment of the present invention is applied.
Figure 15A:
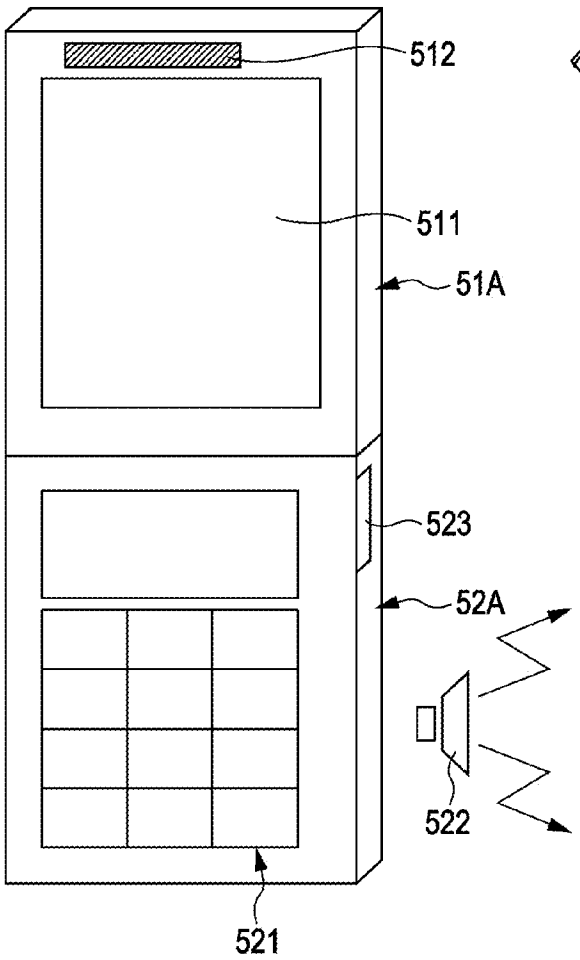

FIG. 15A and FIG. 15B are diagrams illustrating a receiving system (receiver) containing a cell phone as an example of an electronic apparatus to which an antenna device according to a fourth embodiment of the present invention is applied. FIG. 15A and FIG. 15B represent different states of the antenna device, respectively.

The antenna device 10C of the fourth embodiment has the same configuration as that of the antenna device 10 shown in FIG. 4B except for the follows: The antenna device 10C employs an audio plug typified by a 3.5-mm audio plug, which is now commonly used in the art, as a round plug 30C to allow the plug for audio circuit to be also used as an antenna terminal.

In this case, the conversion adaptor 60C may employ an earphone connector as a round jack 61C. Thus, the antenna device 10C of the fourth embodiment can be exemplified such that the earphone jack can be functioned as an antenna terminal and the audio-type round plug 30C of the antenna device 10C is attached to the round jack 61C that forms the earphone jack, making a connection between the antenna device 10C to make a connection. The antenna device 10C of the fourth embodiment can be also exemplified such that sounds can be output from the speaker 522 of the cell phone 50C and the broadcast can be received by the rod antenna device 10C when allowing two or more persons to watch broadcasts based on the one-segment broadcasting technology or the like.

Figure 16A:
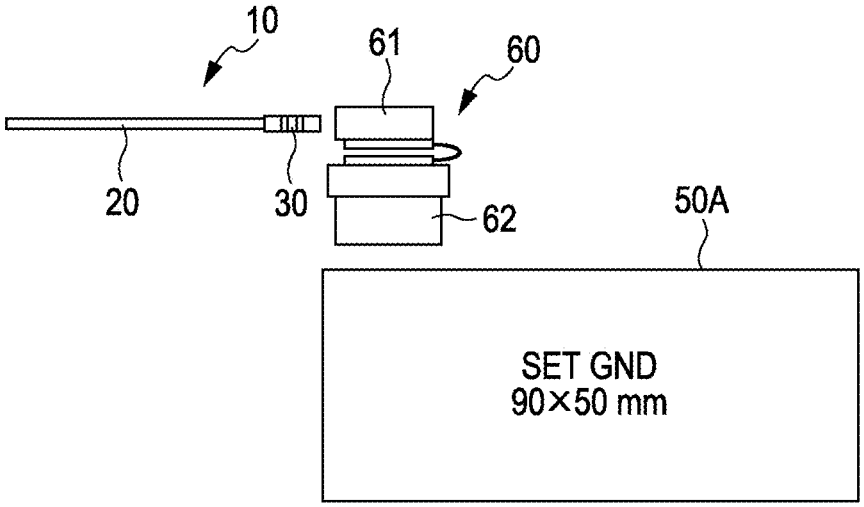
FIG. 16A and FIG. 16B are diagrams illustrating a cell phone to which an antenna device according to the fourth embodiment is applied using a conversion adaptor.
Figure 16B:
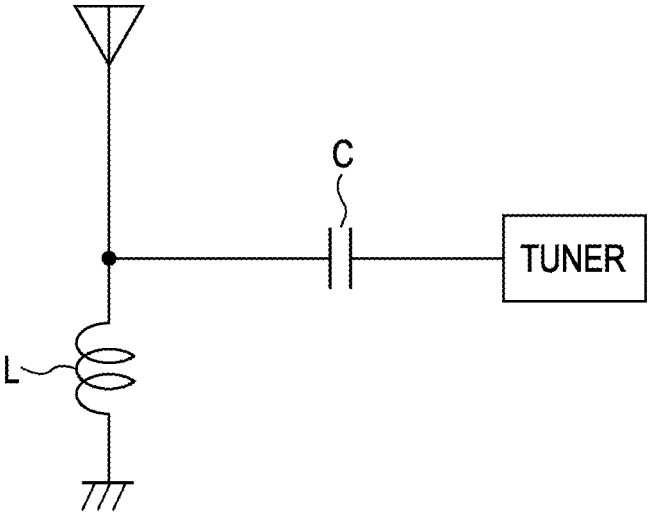

FIG. 16A and FIG. 16B are diagrams illustrating the cell phone using the conversion adaptor with the antenna device according to the fourth embodiment. That is, FIG. 16A shows the main body of the closed cell phone and FIG. 16B shows the equivalent circuit of the cell phone. In this embodiment, for example, the set ground GND is 90×50 mm in assumed size. In addition, it is also set to become high impedance at the frequency band used.

Figure 17:
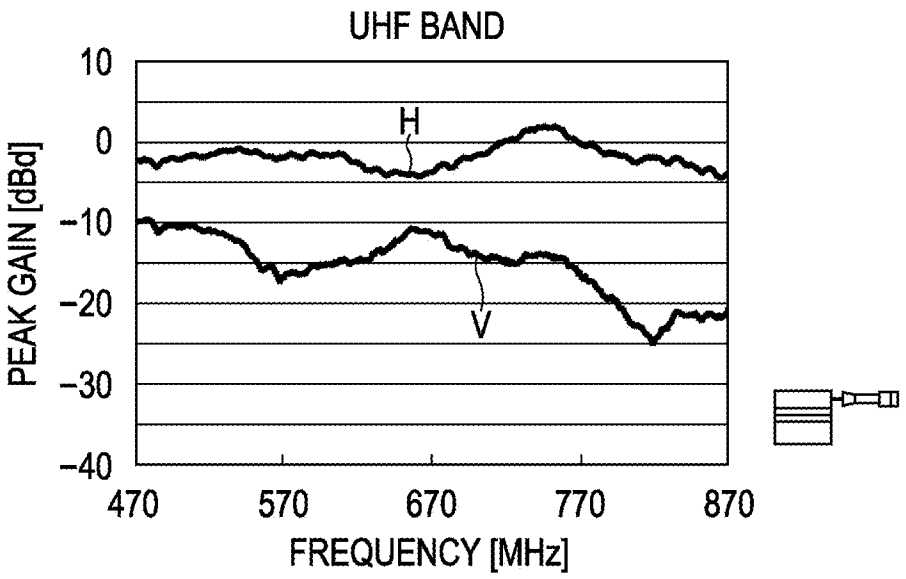
FIG. 17 is a diagram illustrating the peak-gain performance of the antenna device according to the fourth embodiment when the antenna device is applied to the closed cell phone using the conversion adaptor.

FIG. 17 is a diagram illustrating the peak-gain performance of the antenna device according to the fourth embodiment when the antenna device is applied to the closed cell phone using the conversion adaptor. In FIG. 17, the upper panel is a characteristics chart in which the curved line "H" represents the characteristic of a horizontally-polarized wave and the curved line "V" represents the characteristic of a vertically-polarized wave. In addition to the characteristics chart, tables that represent the results of the measurements in detail are also shown in FIG. 17.

In the case of applying the antenna device of the first embodiment to the cell phone using the conversion adaptor, the state of null is partially observed. However, as shown in FIG. 17, it is found that there is substantially no effect on the gain at a frequency of approximately 520 MHz.

According to the present embodiment, as described above, the rod-shaped, removable antenna device 10 is provided for the conversion adaptor 60C with the standard round jack 61 to easily realize an ideal antenna device when the performance degradation of the antenna occurs.

5. Fifth Embodiment

Figure 18:
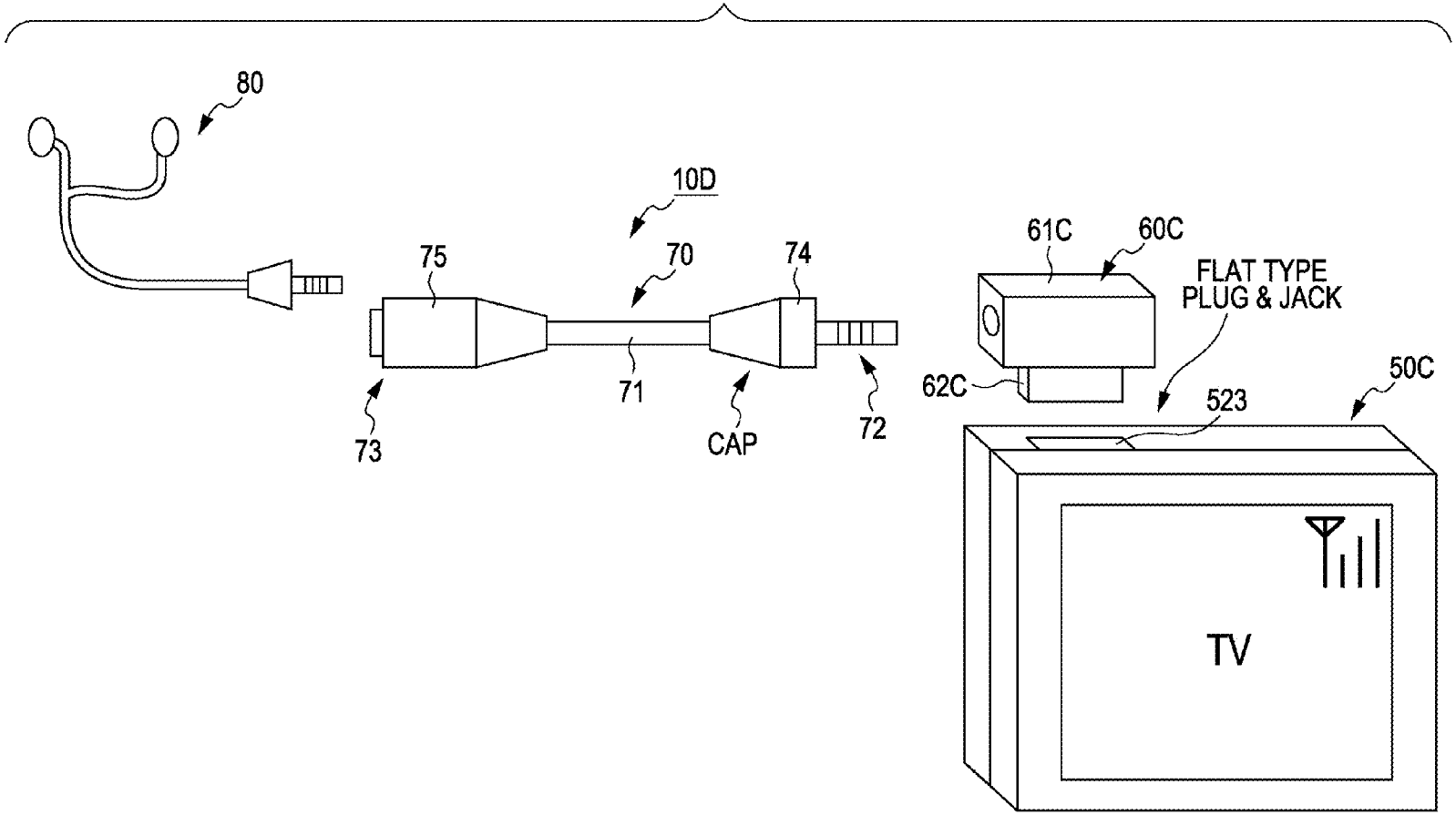
FIG. 18 illustrates a receiving system (receiver) containing a cell phone as an example of the electronic apparatus to which the antenna device according to a fifth embodiment of the present invention is applied.

FIG. 18 illustrates a receiving system (receiver) containing a cell phone as an example of an electronic apparatus to which an antenna device according to a fifth embodiment of the present invention is applied.

An antenna device 10D according to a fifth embodiment of the present invention is different from one of the fourth embodiment in that it includes an antenna cable 70 and an earphone cable 80 in place of the rod antenna element 20 and the round plug 30C of the antenna device 10.

The antenna cable 70 includes a shielded coaxial cable 71, a 3.5-mm three-pole plug 72 formed on one end of the cable 71, and a 3.5-mm three-pole jack 73 formed on the other end of the cable 71. The three-pole plug 72 and the three-pole jack 73 are provided with caps 74 and 75, respectively.

Figure 19:
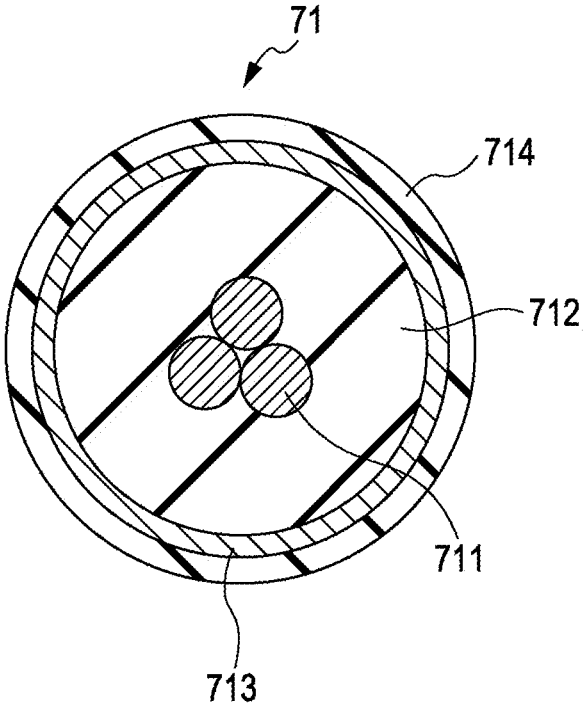
FIG. 19 is a diagram illustrating an exemplary configuration of the shielded coaxial cable.

FIG. 19 is a diagram illustrating an exemplary configuration of the shielded coaxial cable 71.

The coaxial cable 71 is a three-core coaxial cable constructed of a plurality of core wires 711 that form audio L and R lines and an inner insulator 712 for insulating the core wires 711. The coaxial cable 71 includes a shield 713 arranged on the periphery of the inner insulator 712 and an outer insulator (outer cover or jacket) 714, such as an elastomer, covering the entire peripheral surface of the coaxial cable 71. The core wire 711 may be made up of polyurethane wires with aramid fibers. The insulator 712 may be made of PE cross-linked by X-ray irradiation. Furthermore, the shield 713 may be made up of annealed copper wires. More specifically, the shield 713 may be formed of a braided shield composed of a plurality of conductive wires, such as annealed copper wires, which are woven together. Furthermore, the braided shield has been known as a static shield with appropriate flexibility, folding strength, and mechanical strength as well as a little generation of gap in the shied even when bending. The core wires 711 and the shield 713 have high frequency impedance.

Figure 20A:
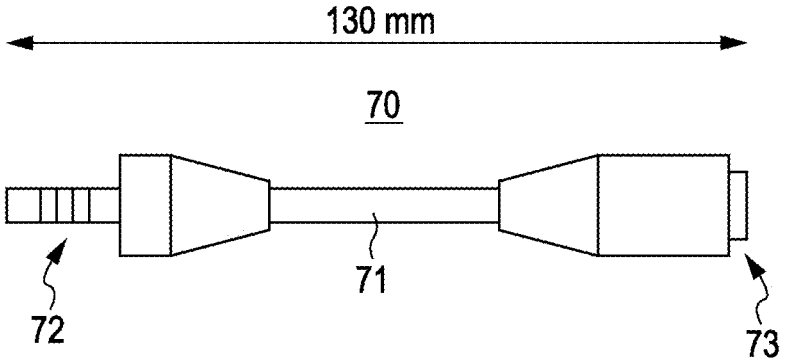
FIG. 20A and FIG. 20B are diagrams illustrating an equivalent circuit of the antenna cable and the shielded coaxial cable.
Figure 20B:
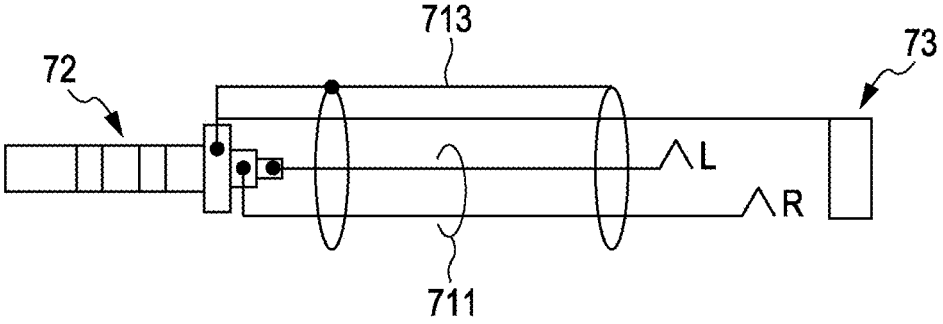

FIG. 20A illustrates the antenna cable 70 with the shielded coaxial cable 71 and FIG. 20B illustrates the equivalent circuit thereof.

The antenna cable 70 is set to 130 mm in total length, including both the plug 72 and the jack 73. The L line and R line composed of the core wires 711 are connected to signal lines of the three-pole plug 72 and the shield 713 is connected to, for example, the grand terminal (reference terminal) of the three-pole plug 72.

All or part of the antenna cable 70 and the earphone cable 80 constructed as described above may be functioned as an antenna device 10D for receiving radio or TV broadcasting.

In this embodiment, as described above, the earphone is functioned as an antenna. Therefore, for example, when watching a TV program while listening sounds through the earphone in consideration of other people on the train, the earphone can be functioned as an antenna device 10D and simultaneously used for listening sounds. In particular, any projected material, such as a rod antenna, may become a nuisance in a place full of people, such as a packed train. Therefore, it is preferable that the antenna device 10D is provided with the earphone cable 80 and the antenna cable 70 with high flexibility.

6. Sixth Embodiment

Figure 21:
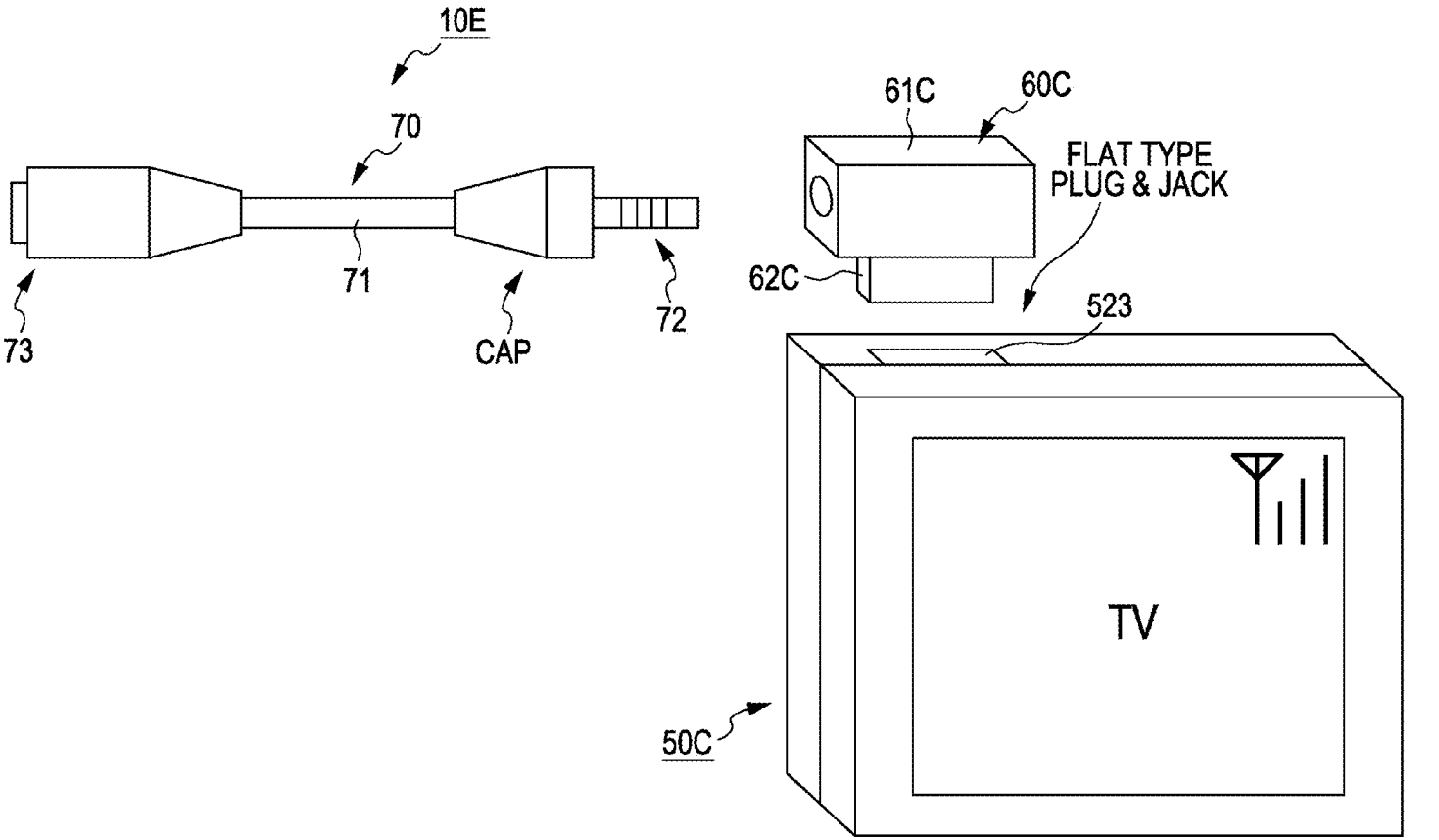
FIG. 21 illustrates a receiving system (receiver) containing a cell phone as an example of an electronic apparatus to which an antenna device according to a sixth embodiment of the present invention is applied.

FIG. 21 illustrates a receiving system (receiver) containing a cell phone as an example of an electronic apparatus to which an antenna device according to a sixth embodiment of the present invention is applied.

An antenna device 10E according to the sixth embodiment of the present invention is different from one of the fifth embodiment in that it is substantially constructed as a rod antenna from only an antenna cable 70 without using any earphone or cable.

In this case, since the high flexible antenna cable 70 is used as an antenna device 10E, compared with the rod antenna, it does not become comparatively obstructive in a place full of people, such as a packed train.

7. Seventh Embodiment

Next, an exemplary configuration of a conversion adaptor according to a seventh embodiment of the present invention will be described.

Figure 22:
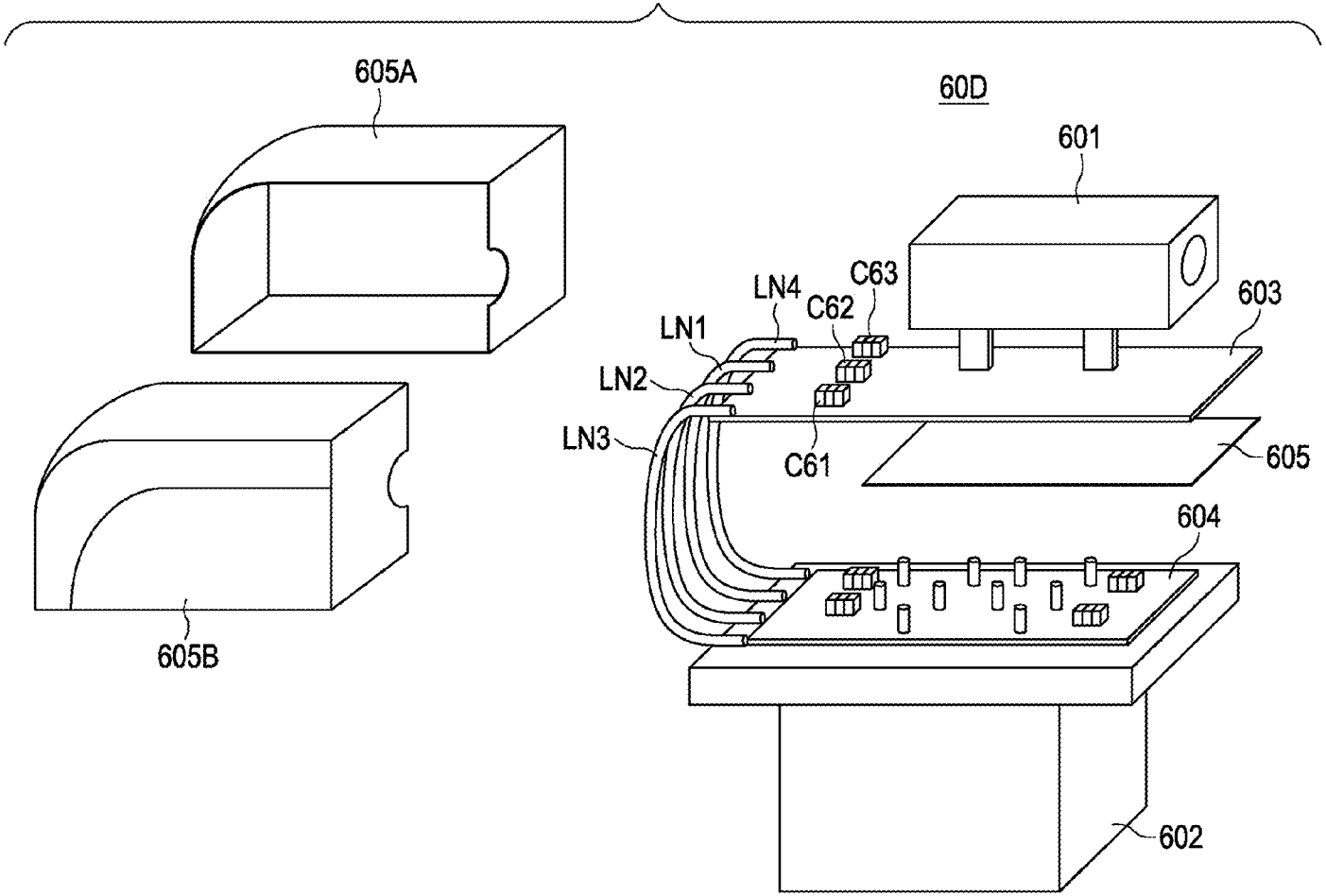
FIG. 22 is a schematic perspective diagram illustrating an exemplary configuration of the exploded conversion adaptor according to a seventh embodiment of the present invention.

FIG. 22 is a schematic perspective diagram illustrating an exemplary configuration of the exploded conversion adaptor according to the seventh embodiment of the present invention.

The conversion adaptor 60D shown in FIG. 22 is constructed as a conversion adaptor of a system to which any of antenna apparatuses 10C to 10E with their respective audio plugs according to the fourth to sixth embodiment.

The conversion adaptor 60D includes a four-pole round jack 601, an 18-pin flat plug 602, a four-pole jack board 603, an 18-pin board 604, Lumirror (trademark; manufactured by Toray Industries, Inc.) 605 arranged between the boards, and cases 605A and 605B which house these components except for the 18-pin flat plug 602. Both the four-pole jack board 603 and the 18-pin board 604 are formed as double-sided boards, respectively. There four wires LN1, LN2, LN3, and LN4 corresponding to four terminals of the four-pole jack 603 to make connections among the corresponding terminals.

Figure 23:
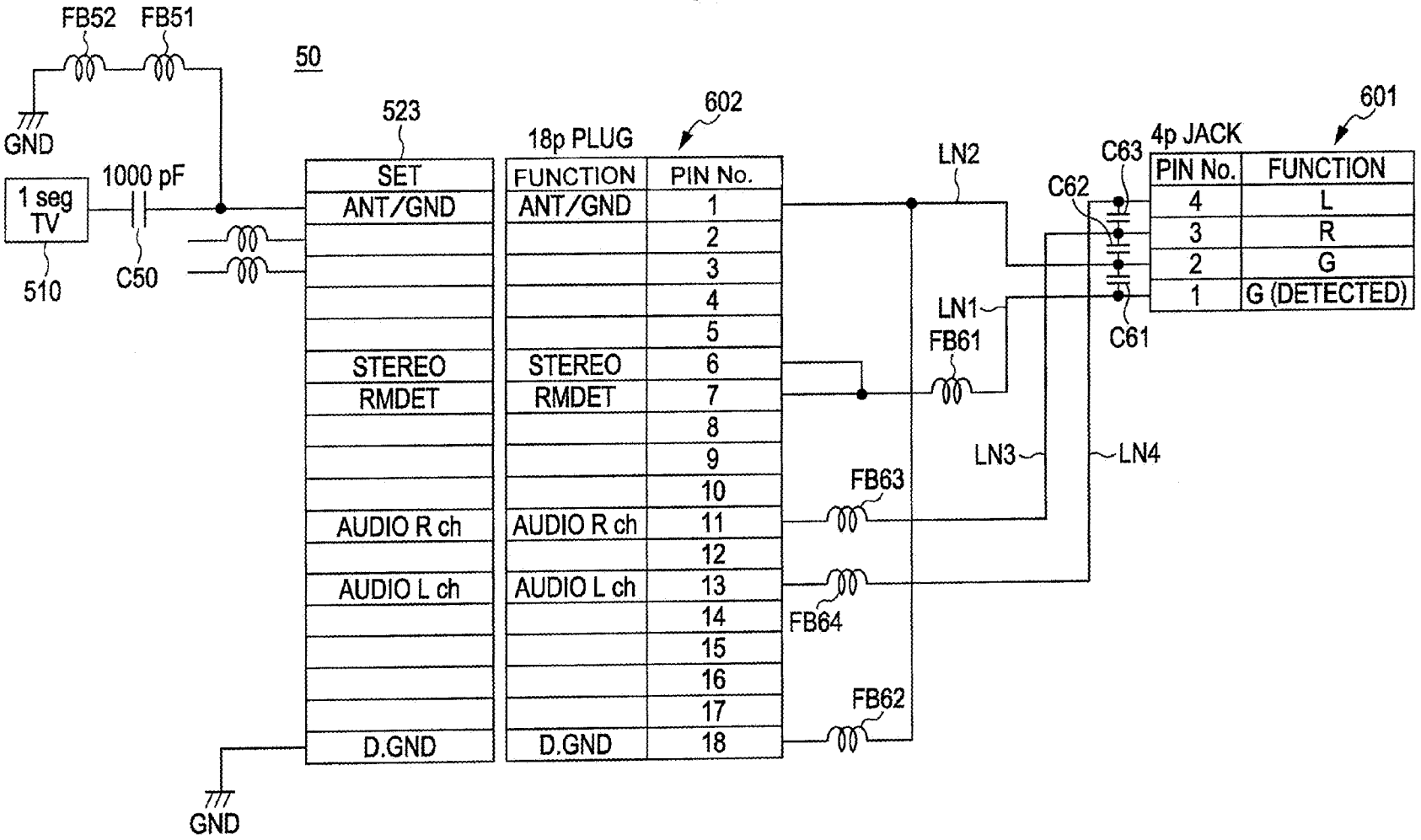
FIG. 23 is an exemplary wiring diagram when the conversion adaptor is applied to a cell phone as an electronic apparatus with a television-receiving function according to any of the fourth to sixth embodiments.
Figure 24:
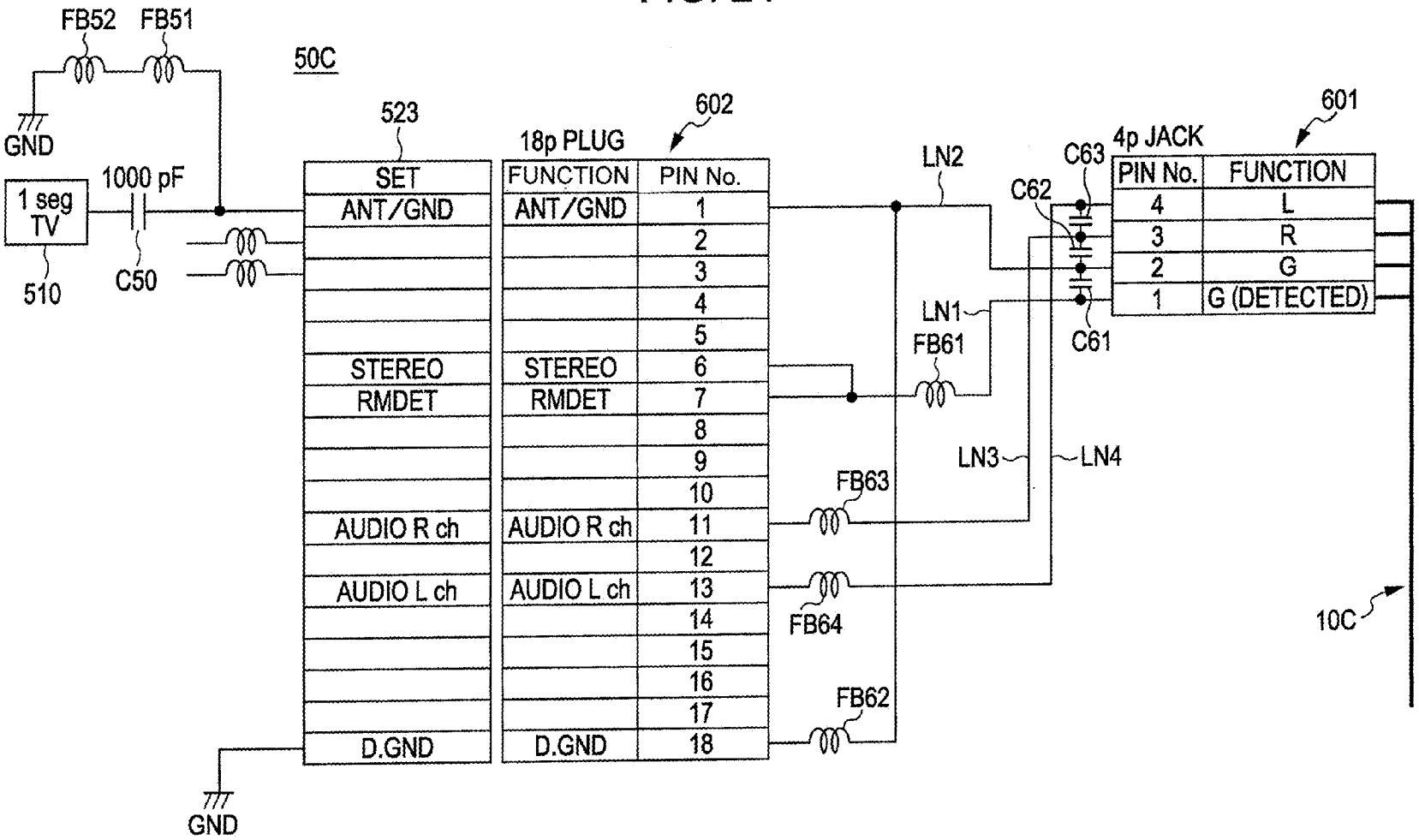
FIG. 24 is an exemplary wiring diagram when the conversion adaptor is applied to a cell phone as an electronic apparatus with a television-receiving function, where a single-pole rod antenna device is used.

FIG. 23 is an exemplary wiring diagram when the conversion adaptor is applied to a cell phone as an electronic apparatus with a television-receiving function according to any of the fourth to sixth embodiments. FIG. 24 is an exemplary wiring diagram when the conversion adaptor is applied to a cell phone as an electronic apparatus with a television-receiving function, where a single-pole rod antenna device is used. In FIG. 23 and FIG. 24, the same wiring configuration is employed.

The four-pole jack 601 includes first to fourth pins (terminals) 601-1 to 601-4.

The first pin 601-1 functions as a pin for detection of ground G.

The second pin 601-2 functions as ground G. The third pin 601-3 functions as an R channel (Rch).

The fourth pin 601-4 functions as an L channel (Lch).

The 18-pin flat plug 602 includes first to 18th pins 602-1 to 602-18. However, in the 18-pin flat plug 602, the first pin 602-1, the sixth pin 602-6, the seventh pin 602-7, the 11th pin 602-11, the 13th pin 602-13, and the 18th pin 602-18 are used.

The first pin 602-1 functions as an antenna (ANT)/ground (GND) pin.

The sixth pin 602-6 functions as a STEREO pin.

The 7th pin 602-7 functions as a RMDET pin.

The 11th pin 602-11 functions as an audio Rch pin.

The 13th pin 602-13 functions as an audio Lch pin.

The 18th pin 602-18 functions as a D GND (ground) pin. Here, pins corresponding to the 18-pin flat plug 602 are assigned to the flat jack 523 of the cell phone 50C.

As a set, on the side of the cell phone 50C, the ANT/GND pin is connected to a television tuner 510 for one-segment broadcasting via a capacitor C50. In addition, it is also connected to set grand GND via ferrite beads FB51 and FB52.

Next, the configuration of the connection between the four-pole round jack 601 and the 18-pin flat plug 602 will be described.

The first pin 601-1 of the four-pole jack 601 is connected to both the sixth pin 602-6 and the seventh pin 602-7 of the flat plug 602 via the wire LN1.

In addition, a ferrite bead FB61 is arranged on the plug's side of the wire LN1.

The second pin 601-2 of the four-pole jack 601 is connected to both the first pin 602-1 and the 18th pin 602-18 of the flat plug 602 via the wire LN2.

In addition, a ferrite bead FB62 is arranged on the side of the wire LN2 facing to the 18th pin 602-18 of the plug.

The third pin 601-3 of the four-pole jack 601 and the 11th pin 602-11 of the flat plug 602 are connected to each other via the wire LN3.

In addition, a ferrite bead FB63 is arranged on the side of the wire LN3 facing to the 11th pin 602-11 of the plug.

The fourth pin 601-4 of the four-pole jack 601 and the 13th pin 602-13 of the flat plug 602 are connected to each other via the wire LN4.

In addition, a ferrite bead FB64 is arranged on the side of the wire LN4 facing to the 13th pin 602-13 of the plug.

In the configuration of the wiring as shown in FIG. 23, the ferrite beads FB61 to FB64 inserted in the Rch, Lch, and GND pins (terminals) are very effective to prevent a high-frequency current from leaking to the GND terminal du to the connection between the terminals specific to the flat plug 602.

Although measurements against the main body of the set are necessary, it is particularly desired to provide the ferrite beads on the side of the plug 602.

In the case of the single-pole rod antenna shown in FIG. 24, the L, R, and G of the four-pole jack 601 correspond to the same terminal, so that high-frequency signals can be flown into the ground GND.

The ferrite beads FB61 to FB64 are responsible for blocking the high-frequency signals.

Furthermore, in this embodiment, a capacitor C61 is connected between the first pin 601-1 and the second pin 601-2, a capacitor C62 between the second pin 602-2 and the third pin 602-3, and a capacitor C63 between the third pin 601-3 and the fourth pin 601-4 of the four-pole jack 601.

In the present embodiment, in other words, as a characteristic configuration of the wiring, each of the capacitors C61, C62, and C63 is encouraged to be connected between the pins in addition to the capacity coupling due to the line capacity. Thus, the wiring can be constructed to improve the gain characteristics at a range of predetermined frequencies in the UHF band typically used in the art.

According to the seventh embodiment, the capacitor C61 is connected between the wire LN1 and the wire LN2, the capacitor C62 between the wire LN2 and the wire LN3, and the capacitor C63 between the wire LN3 and the LN4. These capacitors C61, C62, and C63 are, for example, mounted on the four-pole jack board 603 as shown in FIG. 22.

As described above, the audio terminal also serves as an antenna terminal, so that any dedicated antenna connector does not have to be used, contributing a decrease in number of components, space saving, miniaturization, and price-reduction of the set.

In order to satisfy both the audio performance and the antenna performance, the leakage of high frequency signals from the audio signal circuit to the grand GND can be prevented using a high-frequency cutoff section including ferrite beads and so on.

Although the rod antenna of the present embodiment is removably attached to the round jack, the jack is also provided for transmission of audio signals via the earphone or the like to allow both the audio and the antenna functions can be realized by one connection terminal. In this embodiment, as shown in FIG. 22, an ideal antenna can be realized without the influence of the set by providing the external conversion adaptor with a high-frequency cutoff section.

Since the plug of the first embodiment or the like is designed as a single-terminal structure formed by machining, the connections of Lch and Rch to the rod antenna in addition to the typical audio GND terminal can be regarded as the connection to the same terminal.

In this case, the performances of the audio L and R terminals can be deteriorated when the connection between these terminals and the high-frequency GND is large at high frequency. As shown in FIG. 24, therefore, a high-frequency cutoff section is formed on the conversion plug to take measures against such disadvantages.

In addition, as described above, it is more effective to install the high-frequency cutoff section on the plug than the inside of a mobile communication apparatus.

In the seventh embodiment, as described above, the capacitor C61 is connected between the wire LN1 and the wire LN2, the capacitor C62 between the wire LN2 and the wire LN3, and the capacitor C63 between the wire LN3 and the LN4.

In the following description, the receiving systems of the fifth and the sixth embodiment will be considered with respect to their gain performance in the presence or absence of capacitors C61 to C63 among the lines.

Figure 25:
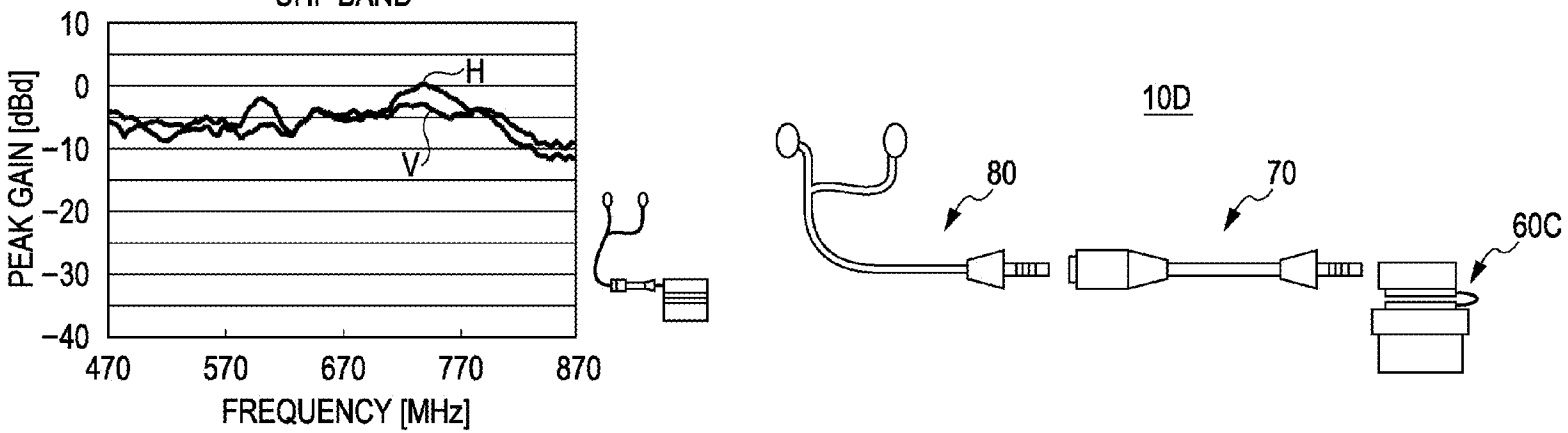
FIG. 25 is a diagram illustrating the peak-gain performance of the receiving system according to the fifth embodiment with respect to frequency in the absence of any capacitor mounted on the conversion adaptor.
Figure 26:
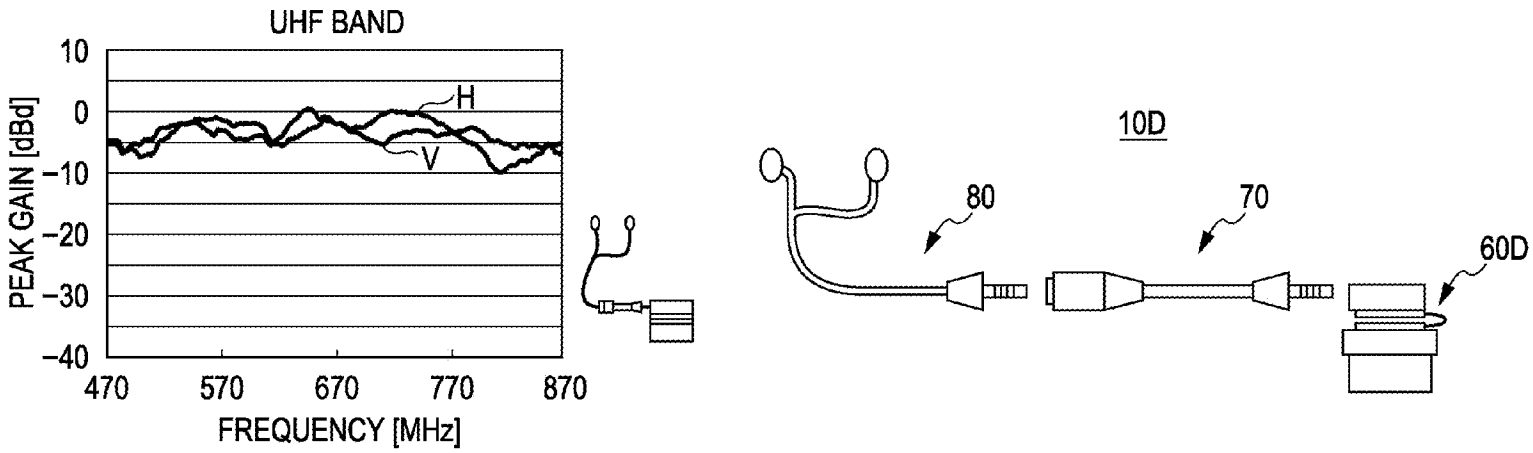
FIG. 26 is a diagram illustrating the peak-gain performance of the receiving system according to the fifth embodiment with respect to frequency in the presence of a capacitor mounted on the conversion adaptor.

Each of FIG. 25 and FIG. 26 is a diagram illustrating the peak-gain performance of the receiving system according to the fifth embodiment with respect to frequency. FIG. 25 illustrates the gain performance of the receiving system in the absence of capacitors C61 to C63 in the conversion adaptor. On the other hand, FIG. 26 illustrates the gain performance of the receiving system in the presence of capacitors C61 to C63 in the conversion adaptor.

In FIG. 25 and FIG. 26, the upper panel is a characteristics chart in which the curved line "H" represents the characteristic of a horizontally-polarized wave and the curved line "V" represents the characteristic of a vertically-polarized wave. In addition to the characteristics chart, tables that represent the results of the measurements in detail are also shown in FIG. 25 and FIG. 26.

As is evident from FIG. 25 and FIG. 26, the receiving system of the fifth embodiment can ensure good antenna gain and can receive broadcasting programs by the sufficient gain at a wide range of frequencies.

However, as is evident from the comparison between FIG. 25 and FIG. 26, the antenna gain in FIG. 26 in which the capacitors C61 to C63 are mounted on the conversion adaptor are improved 2 to 3 dB at a low band frequency of 470 MHz and approximately 8 dB at a high band frequency of 870 MHz, compared with those of the antenna gain in FIG. 25.

Figure 27:
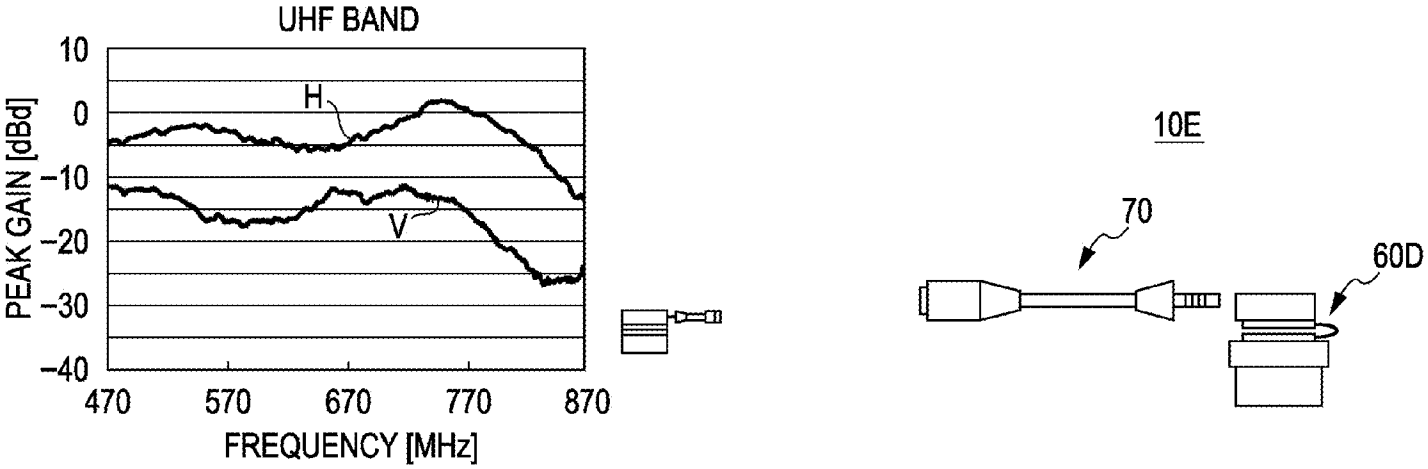
FIG. 27 is a diagram illustrating the peak-gain performance of the receiving system according to the sixth embodiment with respect to frequency in the absence of any capacitor mounted on the conversion adaptor.
Figure 28:
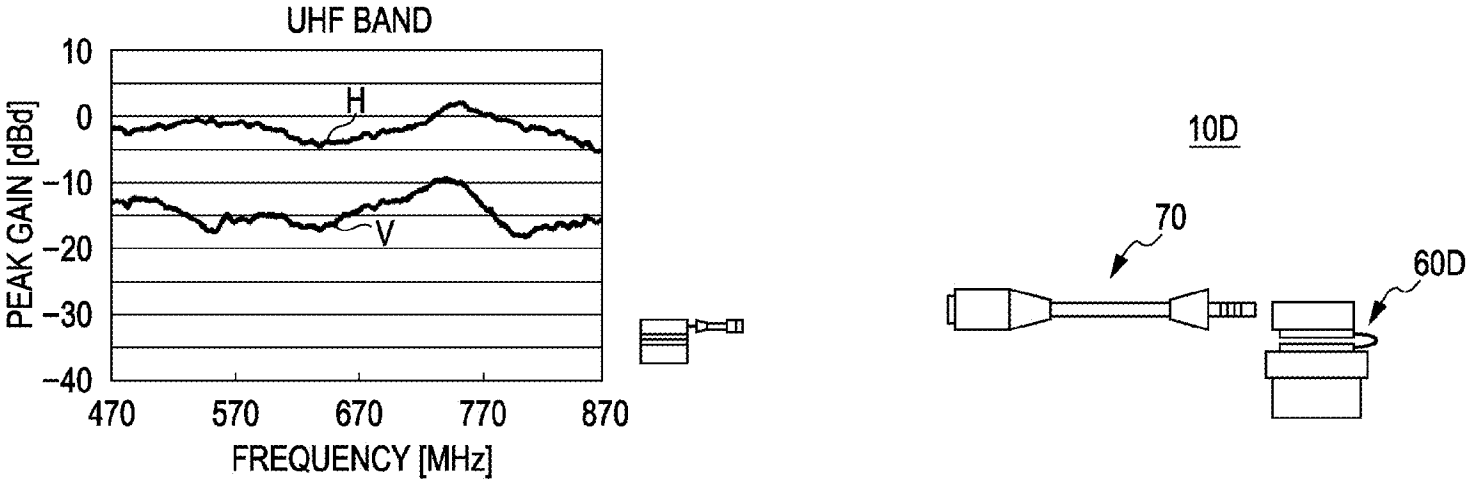
FIG. 28 is a diagram illustrating the peak-gain performance of the receiving system according to the sixth embodiment with respect to frequency in the presence of a capacitor mounted on the conversion adaptor.

Each of FIG. 27 and FIG. 28 is a diagram illustrating the peak-gain performance of the receiving system according to the sixth embodiment with respect to frequency. FIG. 27 illustrates the gain performance of the receiving system in the absence of capacitors C61 to C63 in the conversion adaptor. On the other hand, FIG. 28 illustrates the gain performance of the receiving system in the presence of capacitors C61 to C63 in the conversion adaptor. In FIG. 27 and FIG. 28, the upper panel is a characteristics chart in which the curved line "H" represents the characteristic of a horizontally-polarized wave and the curved line "V" represents the characteristic of a vertically-polarized wave.

In addition to the characteristics chart, tables that represent the results of the measurements in detail are also shown in FIG. 27 and FIG. 28.

As is evident from FIG. 27 and FIG. 28, the receiving system of the sixth embodiment can ensure good antenna gain and can receive broadcasting programs by the sufficient gain at a wide range of frequencies.

However, as is evident from the comparison between FIG. 27 and FIG. 28, the antenna gain in FIG. 28 in which the capacitors C61 to C63 are mounted on the conversion adaptor are improved 2 to 3 dB at a low band frequency of 470 MHz and approximately 8 dB at a high band frequency of 870 MHz, compared with those of the antenna gain in FIG. 27.

As described above, when the capacitors are connected among the lines in this way, the antenna gain can be improved approximately 2 to 8 dB. In the following description, therefore, such an improvement effect will be considered.

Figure 29:
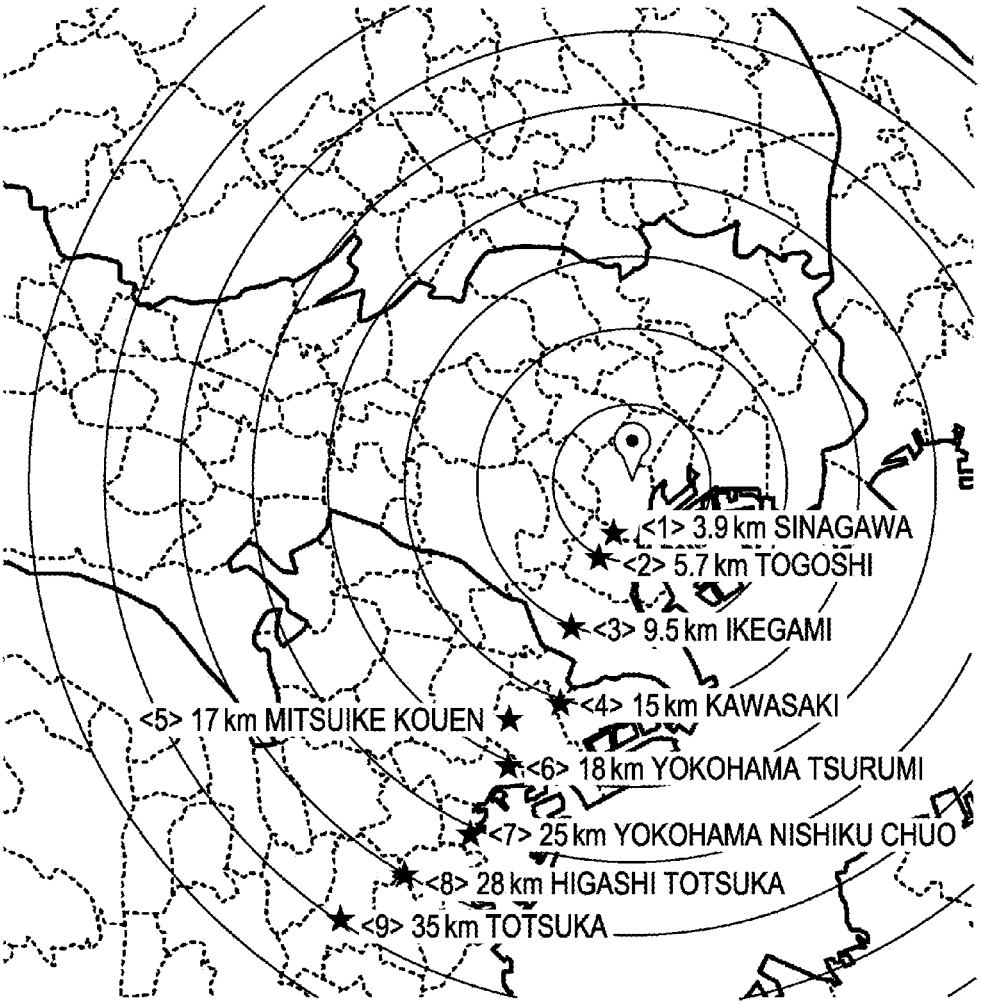
FIG. 29 is a diagram illustrating the points on a map at which the received power of a dipole antenna.
Figure 30:
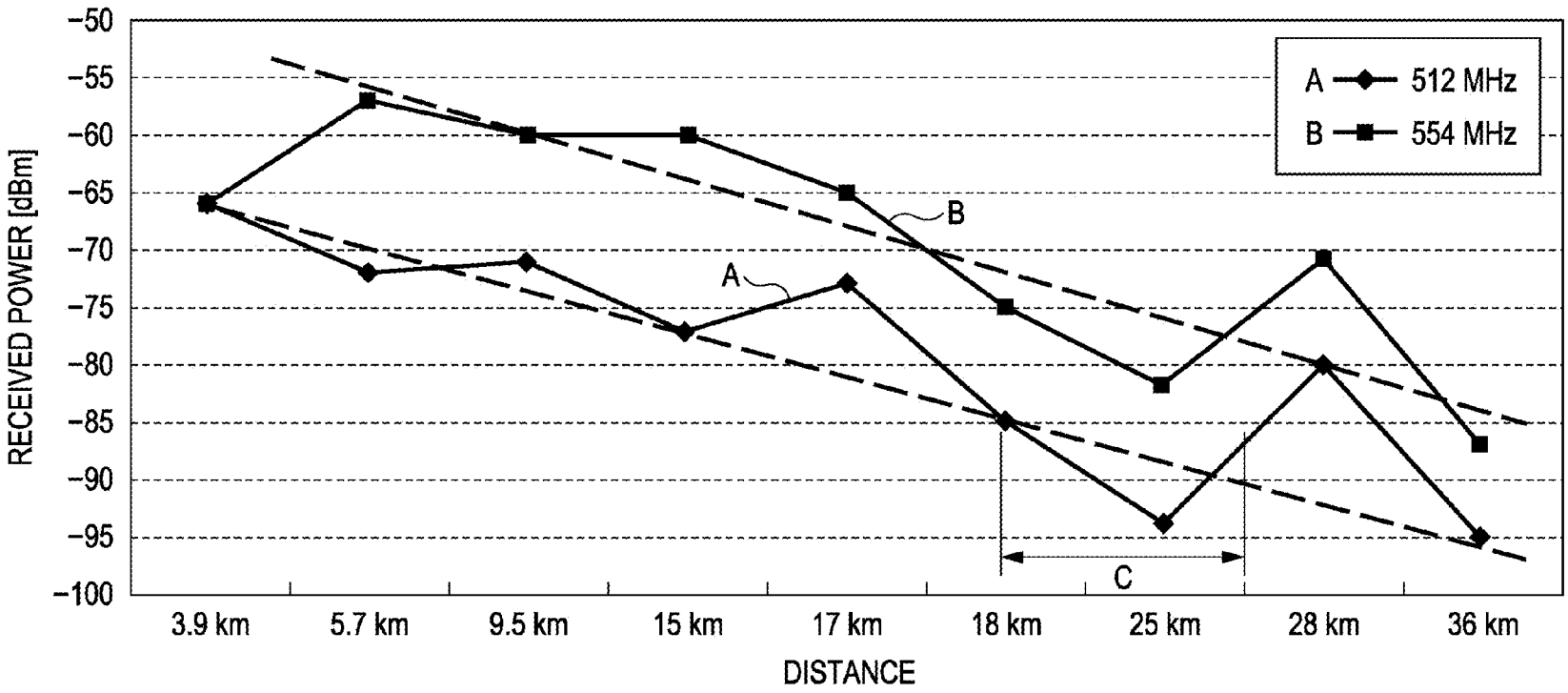
FIG. 30 is a diagram illustrating the results of measuring the received power of the dipole antenna.

FIG. 29 is a diagram illustrating the points on a map at which the received power of a dipole antenna. FIG. 30 is a diagram illustrating the results of measuring the received power of the dipole antenna.

In this measurement, the following points were selected as measurement points with respect to the power-transmitting point in the capital sphere.

That is, as shown in FIG. 29, the measurement points were located 3.9 km (Shinagawa), 5.7 Km (Togoshi), 9.5 km (Ikegami), 15 km (Kawasaki), 17 km (Mitsuike kouen), 18 km (Yokohama tsurumi), 25 km (Yokohama nishi-ku, Chuo), 28 km (Higashi-Tozuka), and 35 km (Totsuka) far from the power-transmitting point.

The antenna gain is improved approximately 2 to 8 dB when the capacitors are connected among the lines. In FIG. 30, furthermore, the curved line "A" represents the performance of the antenna at a received power of 512 MHz and the curved line "B" represents the performance of the antenna at a received power of 554 MHz.

In FIG. 30, as represented by the arrow C, a deterioration of 5 dB with respect to the dipole antenna leads to narrow the receiving distance approximately 10 km. Therefore, as shown in the seventh embodiment, it is considered that the effect of improved receiver sensitivity is large because of extending the receiving distance approximately 10 km when the antenna gain is improved approximately 5 dB when the capacitors are arranged among the lines.

However, the receiver sensitivity varies because of various kinds of changes in the shape of the land, the height of the land, buildings, and so on.

In addition, the receiver sensitivity varies as a transmission loss varies depending on the frequency.

Figure 31:
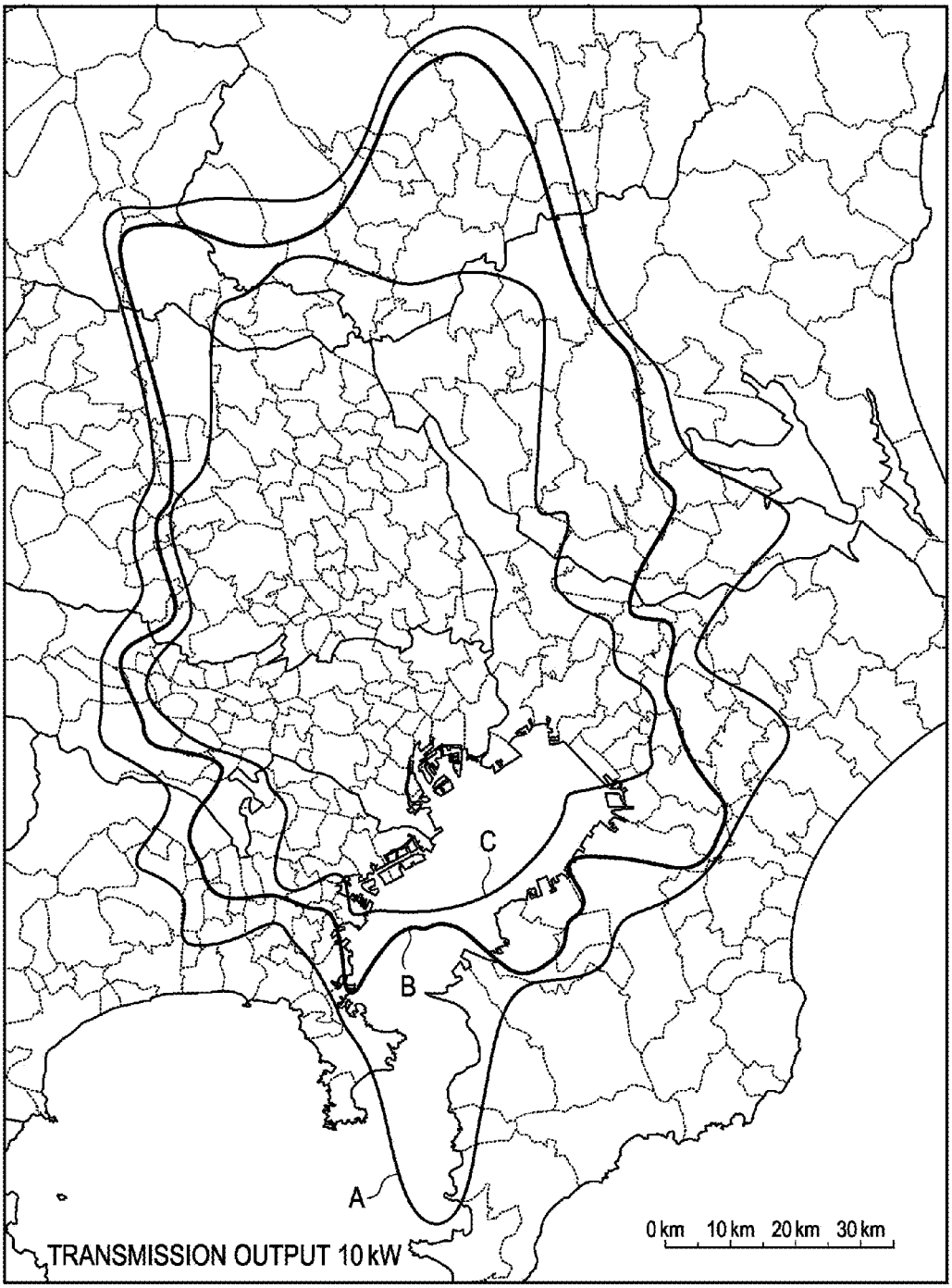
FIG. 31 is a diagram illustrating an exemplary field intensity map obtained by a simulator.

FIG. 31 is a diagram illustrating an exemplary field intensity map obtained by a simulator.

In this example, the simulation was performed on the receiving areas at a transmission output of 10 kW, 27 ch, and 557 MHz with respect to the shape of the land, the height of the land, and so on.

If the receiver sensitivity of a tuner is −87 dBm, then the field intensity corresponds to 40 dBμV/m.

In FIG. 31, an area represented by "A" corresponds to a field intensity of 40 dBμV/m, an area represented by "B" corresponds to a field intensity of 45 dBμV/m, and an area represented by "C" corresponds to a field intensity of 50 dBμV/m.

As is evident from FIG. 31, when the capacitors are connected among the lines, the antenna gain can be improved approximately 5 dB. Therefore, the receiving area can be extremely extended.

In the seventh embodiment, furthermore, the example in which the capacitors C61 to C63 are arranged on the four-pole jack has been described. Alternatively, these capacitors may be arranged on the side of the antenna cable or on the side of the electronic apparatus provided as a set. Also in this case, the same effect as that of the seventh embodiment can be obtained.

As described above, according to the present invention, the configuration of the antenna apparatus is extremely simple and the miniaturization, price-down, and an improvement in reliability can be attained.

Furthermore, in the present embodiment, the use of the round plug and the round jack leads to a great advantage in rotation mechanism.

In other words, it is necessary for the antenna device to have with the unidirectional rotation mechanism (XY plane). In contrast, the other rotation mechanism (YZ plane) can be attained by the connection between the round plug and the round jack.

Thus, the entire rotation mechanism of the antenna device itself can be prevented from complication.

In addition, price-down and miniaturization can be realized by lowering the number of compartments.

Since the antenna device can also serve as an audio jack, a dedicated antenna connector does not have to be used. A decrease in number of components and a decrease in space for the components can realize miniaturization and price reduction.

The present application contains subject matter related to that disclosed in Japanese Priority Patent Application JP 2009-083213 filed in the Japan Patent Office on Mar. 30, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna device comprising:

a round plug having a rotation mechanism section on one end thereof, wherein said round plug is removably attached to a round audio jack arranged in an electronic apparatus, the round plug having a sleeve portion, a tip portion and a ring portion formed between the sleeve portion and the tip portion, wherein the sleeve portion comprises the rotation mechanism section and a cylindrical metal pipe machined into a 3.5 millimeter plug and to include a hole from the tip portion to a housing portion comprising two or more plate-shaped flanges of the rotation mechanism section; and a rod antenna element and a connection portion having a lock tip portion, the lock tip portion including one or more notches formed on an arc-shaped edge of the lock tip portion, wherein said rod antenna element is connected to said rotation mechanism section of said round plug via the connection portion and rotatable in a predetermined direction and in rotation angles determined by the one or more notches, wherein the rotation mechanism section is arranged to house the lock tip portion of the connection portion in between the two or more plate-shaped flanges of the rotation mechanism section, wherein said rod antenna element is rotatably extendable, wherein the one or more notches comprise a plurality of notches, wherein the plurality of notches are configured to receive a ball of the rotation mechanism section of said round plug, wherein the ball is forced against the arc-shaped edge of the lock tip portion directly by a spring of the rotation mechanism section of said round plug, wherein the spring is directed toward the rotation mechanism section of said round plug, and wherein a first pivotal support hole is formed in the rod antenna element so that the rod antenna element can be integrally, pivotally supported by a second pivotal support hole of the rotation mechanism section.

2. The antenna device according to claim 1, wherein said round plug is formed as a single-pole plug.

3. The antenna device according to claim 1, wherein said round plug is formed as a multipole plug.

4. The antenna device according to claim 3, wherein said rod antenna element is telescopic.

5. The antenna device according to claim 1, wherein the one or more notches are arranged at angular intervals corresponding to the rotation angles determined by the one or more notches.

6. The antenna device according to claim 1, wherein the rotation mechanism section comprises a locking mechanism comprising injected resin.

7. A conversion adaptor, comprising:

a round audio jack, to which a round plug of an antenna device is removably attached, the round plug comprising a cylindrical metal pipe machined into a 3.5 millimeter plug and to include a hole; and a flat plug having a plurality of pins connected to respective pins of said round audio jack, which can be removably attached to a flat jack of an electronic apparatus as a connection target, wherein:

said round plug is configured to be removably inserted into said round audio jack, said round audio jack being disposed on a first surface of said conversion adaptor, said round plug is configured to connect to a rod antenna element via a rotation mechanism of the round plug and a connection portion, the connection portion having a lock tip portion, the lock tip portion including one or more notches formed on an arc-shaped edge of the lock tip portion, the rod antenna element being rotatable in a predetermined direction and in rotation angles determined by the one or more notches, the one or more notches comprise a plurality of notches, the plurality of notches are configured to receive a ball of the rotation mechanism section of said round plug, the ball is forced against the arc-shaped edge of the lock tip portion directly by a spring of the rotation mechanism section of said round plug, the spring is directed toward the rotation mechanism section of said round plug, a first pivotal support hole is formed in the rod antenna element so that the rod antenna element can be integrally, pivotally supported by a second pivotal support hole of the rotation mechanism section, said flat plug, which is disposed on a second surface of said conversion adaptor, is configured to be removably inserted into said flat jack, the second surface of the conversion adaptor is longer than the first surface of the conversion adaptor, a capacitor is connected between said respective pins of said round audio jack, and the rotation mechanism section comprises a locking mechanism comprising injected resin.

8. The conversion adaptor according to claim 7, wherein wiring that connects said pins of said round audio jack to the corresponding pins of said flat plug is provided with a high-frequency cutoff section.

9. The conversion adaptor according to claim 8, wherein said high-frequency cutoff section is arranged on the side of said flat plug.

10. The conversion adaptor according claim 9, wherein said round audio jack is capable of transmitting a signal or electric power.

11. The conversion adaptor according to claim 10, wherein the round plug is a round multipole plug and said round multipole plug is removably attached to said round audio jack and is formed of an audio plug.

12. The conversion adaptor according to claim 7, wherein the first surface of the conversion adaptor is substantially perpendicular to the second surface of the conversion adaptor.

13. A receiver comprising:

an antenna device having a round plug, the round plug comprising a cylindrical metal pipe machined into a 3.5 millimeter plug and to include a hole;

a conversion adapter including a round audio jack to which said round plug of said antenna device is removably attached and a flat plug having a plurality of pins to be connected to respective pins of said round audio jack; and an electronic apparatus having a function of receiving a broadcast wave and having a flat jack to which said flat plug of said conversion adapter is removably attached, wherein:

said round plug is configured to be removably inserted into said round audio jack, said round audio jack being disposed on a first surface of said conversion adapter, said flat plug, which is disposed on a second surface of said conversion adapter, is configured to be removably inserted into said flat jack, and the second surface of the conversion adapter is longer than the first surface of the conversion adapter, and wherein said antenna device includes:

a rotation mechanism section arranged on one end of said round plug, and a rod antenna element and a connection portion having a lock tip portion, the lock tip portion including one or more notches formed on an arc-shaped edge of the lock tip portion, wherein said rod antenna element is connected to said rotation mechanism section of said round plug via the connection portion and rotatable in a predetermined direction and in rotation angles determined by the one or more notches, wherein said rod antenna element is rotatably extendable, wherein the one or more notches comprise a plurality of notches, wherein the plurality of notches are configured to receive a ball of the rotation mechanism section of said round plug, wherein the ball is forced against the arc-shaped edge of the lock tip portion directly by a spring of the rotation mechanism section of said round plug, wherein the spring is directed toward the rotation mechanism section of said round plug, wherein a first pivotal support hole is formed in the rod antenna element so that the rod antenna element can be integrally, pivotally supported by a second pivotal support hole of the rotation mechanism section, and the rotation mechanism section comprises a locking mechanism comprising injected resin.

14. The receiver according to claim 13, wherein the first surface of the conversion adapter is substantially perpendicular to the second surface of the conversion adapter.

15. The receiver according to claim 13, wherein the one or more notches are arranged at angular intervals corresponding to the rotation angles determined by the one or more notches.

16. A receiver comprising:

an antenna device having a round plug, the round plug comprising a cylindrical metal pipe machined into a 3.5 millimeter plug and to include a hole;

a conversion adapter including a round audio jack to which said round plug of said antenna device is removably attached and a flat plug having a plurality of pins to be connected to respective pins of said round audio jack; and an electronic apparatus having a function of receiving a broadcast wave and having a flat jack to which said flat plug of said conversion adapter is removably attached, wherein:

said round plug is configured to be removably inserted into said round audio jack, said round audio jack being disposed on a first surface of said conversion adapter, said flat plug, which is disposed on a second surface of said conversion adapter, is configured to be removably inserted into said flat jack, the second surface of the conversion adapter is longer than the first surface of the conversion adapter, and said antenna device includes a rotation mechanism section arranged on one end of said round plug and a rod antenna element and a connection portion having a lock tip portion, the lock tip portion including one or more notches formed on an arc-shaped edge of the lock tip portion, wherein said rod antenna element is connected to said rotation mechanism section of said round plug via the connection portion and rotatable in a predetermined direction and in rotation angles determined by the one or more notches, and wherein said rod antenna element is rotatably extendable, wherein the one or more notches comprise a plurality of notches, wherein the plurality of notches are configured to receive a ball of the rotation mechanism section of said round plug, wherein the ball is forced against the arc-shaped edge of the lock tip portion directly by a spring of the rotation mechanism section of said round plug, wherein the spring is directed toward the rotation mechanism section of said round plug, wherein a first pivotal support hole is formed in the rod antenna element so that the rod antenna element can be integrally, pivotally supported by a second pivotal support hole of the rotation mechanism section, the rotation mechanism section comprises a locking mechanism comprising injected resin, and wherein a capacitor is connected between at least one of transmission lines of said antenna device, said respective pins of said round audio jack of said conversion adapter, and pins of said jack of said electronic apparatus.

17. The receiver according to claim 16, wherein the first surface of the conversion adapter is substantially perpendicular to the second surface of the conversion adapter.

18. The receiver according to claim 16, wherein the one or more notches are arranged at angular intervals corresponding to the rotation angles determined by the one or more notches.

* * * * *